US008348693B2

(12) United States Patent
Stowers et al.

(10) Patent No.: US 8,348,693 B2
(45) Date of Patent: Jan. 8, 2013

(54) ELECTRICAL CONNECTOR INTERFACE WITH LATCH OPERATED BY THREADED DRIVE SHAFT

(75) Inventors: Jeffery P. Stowers, Mt. Sidney, VA (US); Randall C. Garman, Waynesboro, VA (US); Randall L. Herron, Waynesboro, VA (US); Darryl M. Ashby, Weyers Cave, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 241 days.

(21) Appl. No.: 12/942,934

(22) Filed: Nov. 9, 2010

(65) Prior Publication Data

US 2011/0111619 A1 May 12, 2011

Related U.S. Application Data

(60) Provisional application No. 61/308,875, filed on Feb. 26, 2010, provisional application No. 61/259,627, filed on Nov. 9, 2009.

(51) Int. Cl.
*H01R 13/627* (2006.01)

(52) U.S. Cl. ..... 439/364; 439/953

(58) Field of Classification Search ..... 439/364, 439/324, 350, 953

See application file for complete search history.

(56) References Cited

U.S. PATENT DOCUMENTS

| | | | | |
|---|---|---|---|---|
| 2,313,481 | A * | 3/1943 | Rendano | 416/100 |
| 2,739,292 | A * | 3/1956 | Modrey et al. | 439/324 |
| 2,892,990 | A * | 6/1959 | Werndl | 439/265 |
| 3,118,713 | A * | 1/1964 | Ellis | 439/38 |
| 3,159,444 | A * | 12/1964 | Stine, Jr. | 439/255 |
| 3,425,025 | A * | 1/1969 | Williams | 439/347 |
| 3,648,002 | A * | 3/1972 | Du Rocher | 200/265 |
| 3,662,296 | A * | 5/1972 | Newman | 439/135 |
| 3,842,395 | A * | 10/1974 | Tucker | 439/347 |
| 4,026,623 | A * | 5/1977 | Goodman et al. | 439/261 |
| 4,083,619 | A * | 4/1978 | McCormick et al. | 439/310 |

(Continued)

FOREIGN PATENT DOCUMENTS

JP 2543304 B2 7/1996

*Primary Examiner* — Neil Abrams

(74) *Attorney, Agent, or Firm* — 24IP Law Group; Timothy R. DeWitt

(57) ABSTRACT

An interface having a receiver and a test adapter. The receiver has a body and a latch post connected to the body. The latch post has a body, a neck, and a tip with the tip being larger than the neck. The test adapter has a frame and an engagement assembly. The engagement assembly has a drive shaft having first and second ends, a drive knob connected to the first end of the drive shaft, a drive nut connected to the drift shaft near the second end of the drive shaft. The drive nut has a threaded interior portion. The drive assembly further has a drive screw and a drive screw housing. The drive screw has a threaded exterior portion such that the threaded exterior portion of the drive screw engages with the threaded interior portions of the drive nut. A spring extends from the drive screw longitudinally away from the threaded portion of the drive screw. The spring has an enlarged portion at its distal end for gripping the neck of the latch post. Rotation of the drive shaft draws the springs and latch post into a position in which the springs are held in closed position firmly gripping the latch post.

16 Claims, 20 Drawing Sheets

U.S. PATENT DOCUMENTS 4,221,451 A 9/1980 Petrelewicz
4,286,834 A * 9/1981 Goodman et al. ..... 439/191
4,828,510 A * 5/1989 Muzslay ..... 439/352
5,044,975 A * 9/1991 DiBene et al. ..... 439/352
5,366,315 A * 11/1994 Hartley ..... 403/326
5,368,496 A * 11/1994 Ranalletta et al. ..... 439/261
5,376,016 A * 12/1994 Inaba et al. ..... 439/364
5,411,402 A * 5/1995 Bethurum ..... 439/77
5,452,975 A * 9/1995 Grant ..... 411/22
5,562,458 A * 10/1996 Stora et al. ..... 439/348
5,588,855 A * 12/1996 Nankoh ..... 439/188
5,818,691 A * 10/1998 McMahan et al. ..... 361/679.43
5,820,401 A * 10/1998 Hasz et al. ..... 439/364
5,966,023 A 10/1999 Burgers et al.
6,012,939 A * 1/2000 Kunert et al. ..... 439/362
6,116,942 A * 9/2000 Chen et al. ..... 439/362
6,135,781 A * 10/2000 Pope et al. ..... 439/59
6,146,180 A * 11/2000 Betker et al. ..... 439/352
6,257,918 B1 7/2001 Yamamoto
6,522,532 B2 * 2/2003 Liao et al. ..... 361/679.43
6,663,410 B2 * 12/2003 Revis ..... 439/348
6,882,138 B2 4/2005 Langouet et al.
6,896,535 B2 * 5/2005 Yamada et al. ..... 439/289
6,962,498 B2 * 11/2005 Kohen ..... 439/21
7,128,586 B2 * 10/2006 Kung ..... 439/133
7,297,014 B1 * 11/2007 Stowers et al. ..... 439/372
D561,125 S 2/2008 Stowers et al.
7,462,066 B2 * 12/2008 Kohen ..... 439/537
7,641,487 B2 * 1/2010 Morgan ..... 439/158
7,955,111 B2 * 6/2011 Costabel et al. ..... 439/287
8,192,221 B2 * 6/2012 Schmettkamp et al. ..... 439/345
2006/0205253 A1 9/2006 Stowers
2007/0009362 A1 * 1/2007 Tseng ..... 416/210 R
2010/0194417 A1 8/2010 Stowers et al.

* cited by examiner

ELECTRICAL CONNECTOR INTERFACE WITH LATCH OPERATED BY THREADED DRIVE SHAFT

CROSS-REFERENCE TO RELATED APPLICATIONS

The present application claims the benefit of the filing date of U.S. Provisional Patent Application Ser. No. 61/308,875 filed by the present inventors on Feb. 26, 2010 and U.S. Provisional Patent Application Ser. No. 61/259,627 filed on Nov. 9, 2009.

The aforementioned provisional patent applications are hereby incorporated by reference in their entirety.

STATEMENT REGARDING FEDERALLY SPONSORED RESEARCH OR DEVELOPMENT

None

BACKGROUND OF THE INVENTION

1. Field of the Invention

The present invention relates to an apparatus for securing and locking interfaces of two items releasably together and more particularly to an apparatus for securing and locking together an array of electrical connectors in a common frame.

2. Brief Description of the Related Art

A variety of mass interconnect devices have been used in the past. One example of prior art interface systems was disclosed in U.S. Pat. No. 4,329,005, entitled "Slide Cam Mechanism for Positioning Test Adapter in Operative Relationship with a Receiver," which was assigned to Virginia Panel Corporation. In the '005 Patent, the receiver included an inner frame and outer walls. Between the outer walls and adjacent sides of the receiver frame were placed fixed hanger plates provided with straight slots and interior slides having coacting cam slots. The slides were driven by a hand lever and attached round torsion shaft with connected linkage having an over-dead-center locked position. Movement of the hand lever would cause the slides to move parallel to the outer walls and interior sides. Modules for holding various electrical contacts were mounted in the receiver parallel to the direction of movement of the slides.

The individual test adapter, or ITA, disclosed in the '005 patent had four split roller dual bearings or rollers on common dry lube sleeves that would rotate oppositely during the camming action to minimize friction. The individual test adapter rollers rested on dwell shoulders of the cam slots and then descended through the straight slots during movement of the slides of the receiver to produce positive straight-on engagement of the test adapter and receiver multiple contacts. The slides had elongated linear guide bearings with dry lube pads for precision free movement. The slides were connected to a cylindrical torsion shaft via linkage. Like the receiver modules, the ITA modules were mounted in the system in a direction parallel to the ITA sides on which the rollers were located. When modules, pins, patchcords, and perhaps a cover are mounted to or on the interface test adapter, the assembly is sometimes referred to as a "fixture."

Another prior art system has been known as the MAC Panel Series 06, or rotating latch, interface device. In the rotating latch type device, the camming is performed by plates that rotate rather than moving in a linear fashion. In the rotating latch devices, the connector modules have been mounted to the receiver and test adapter frame parallel to the plane of rotation of the rotating latches.

Another prior art system sold by Virginia Panel Corporation included a receiver that included slides similar to those disclosed in the '005 patent but used pins at two corners, diagonal from one other, on the receiver. These pins inhibited vertical movement of the ITA in the receiver to produce straight-on engagement. This prior art system included machined side rails and a cylindrical torsion shaft.

Another prior interface device is known as the TTI Testron VG Series interface device. This device may be in a tabletop or a rack-mounted form. This VG Series device included a fixture support plate mounted to the receiver in a direction perpendicular to the face of the receiver. The receiver would be mounted directly to the test equipment. The TTI Testron fixture, or test adapter, would be engaged to the receiver by lifting the fixture onto a pair of hooks protruding from the face of the receiver and then resting the fixture on the support plate. A handle and gears were used to pull the hooks, and hence, the fixture, into the receiver to cause the electrical contacts in the receiver and the fixture to mate.

Yet another prior art test system was used prior to 1980 in connection with the federal government's F-16 program. That system had a slide plate on each side of the receiver, with each slide plate connecting to the engagement pins on the sides of a corresponding ITA frame and each slide plate being pulled into the receiver via a connection near the center of the slide plate. This system suffered from significant problems of the ITA tilting to some degree and thereby causing contacts to be crushed.

Still other prior art engagement systems include those disclosed in U.S. Pat. No. 5,966,023. In still other prior art engagement systems, others have incorporated the use of a screw together engager that utilizes a range of thread styles including standard, Acme and high pitch helical grooves. The amount of rotation to engage these ranges from 180° to several full turns. One example of such a screw type engager is disclosed in U.S. Pat. No. 5,562,458 entitled "Interface Engagement and Locking System."

The systems that utilize standard threads or single start Acme threads typically require several turns to fully engage. Although they do not need lubrication, they have a tendency to cross-thread easily. The systems that employ helical grooves typically only require 180° of rotation to achieve full engagement but require a high amount of torque and the use of lubrication to maintain an only somewhat smooth feel during the process of engaging and disengaging. Even with the use of lubrication, these systems show a consistent pattern of extremely high wear on some of the components involved in the engagement procedure. The torque and the wear issues worsen over the cycle life of the system. Also, considering the geometry of these systems, the lubrication is required to be applied in an area that threatens sensitive electronic components.

Another more recent system is disclosed in U.S. Pat. No. 7,297,014, which is hereby incorporated by reference. That system incorporated a spring lock design to initially attach the two halves of the system, i.e., a receiver and a test adapter, together after which the use of a multi start Acme lead screw provided a, consistent, low torque means of engagement. The test adapter had a single spring lock pin extending roughly down the center of the test adapter toward the receiver. The single spring lock pin had a plurality of tab near its tip. When engaging the test adapter with the receiver, the tabs on the spring lock pin were initially engaged with a groove or ridge in an opening in the receiver adjacent the spring lock pin when the test adapter is aligned with the receiver for engagement. Thereafter, the handle on the test adapter was turned to cause the Acme lead screw to provide a constant low torque means to draw the test adapter into the receiver via the groove or ridge, which may be referred to as a spring lock bushing in the opening in the receiver.

SUMMARY OF THE INVENTION

In a preferred embodiment, the present invention is an interface having a receiver and a test adapter. The receiver comprises a receiver body, a latch post connected to the receiver body and a receiver guide member. The latch post comprises a latch post body and a latch post tip. The test adapter comprises a test adapter frame, an engagement assembly mounted to the test adapter frame and a test adapter guide member for providing alignment of the test adapter with the receiver. The engagement assembly comprises a drive shaft having first and second ends, the second end of the drive shaft having a threaded interior portion, a drive knob connected to the first end of the drive shaft and a drive screw. The drive screw comprises a threaded exterior portion, the threaded exterior portion of the drive screw engaging with the threaded interior portion of the drive shaft and an engagement member extending longitudinally away from the threaded portion of the drive screw for engaging the latch post in the receiver during engagement of the test adapter with the receiver. The drive shaft may comprise an opening at the second end and a drive nut within the opening in the second end, the drive nut having a threaded interior portion. The interface may further comprise a drive screw housing surrounding the springs, the drive screw housing having a recessed portion adjacent the enlarged portion of the spring when, the engagement assembly is in a disengaged position. The latch post may further comprise a latch post neck between the latch post body and the latch post tip and wherein the latch post neck has a smaller circumference than the latch post tip. The engagement member may comprise a plurality of springs extending from the drive screw, wherein the plurality of springs engage with the latch post tip when the test adapter is mated with the receiver. The test adapter guide member may comprise a rectangular-shaped guide mounted to the test adapter frame and protruding from a face of the test adapter and the receiver guide member may comprise a bushing mounted to the receiver frame and having an opening matching the rectangular shape of the test adapter guide member to permit the test adapter guide member to be inserted into the opening in the bushing and thereby align the test adapter with the receiver. In another embodiment, the test adapter guide member comprises a guide post mounted to the test adapter frame and protruding from a face of the test adapter and the receiver guide member comprises a hole in the receiver frame having an opening matching the guide post to permit the guide post to be inserted into the opening in the receiver frame and thereby align the test adapter with the receiver. The engagement member in the test adapter may comprise a spring or a plurality of springs and a locking tab on one end of each the spring.

The interface may further comprise a header connected to the receiver. The header may comprise a header housing and a plurality of pin cartridges removably mounted in the header housing. Each pin cartridge may comprise a plurality of pins and a casing surrounding a portion of each of the plurality of pins. One or more of the plurality of pins may have a retention structure or means for removably securing the cartridge into the header housing.

In another embodiment, the present invention is an interface comprised of a receiver and a test adapter. The receiver comprises a receiver body, a latch post connected to the receiver body and a guide plate mounted to the receiver body. The latch post comprises a latch post body and a latch post tip. The guide plate has an alignment opening therein that surrounds the latch post. The test adapter comprises a test adapter frame, an engagement assembly mounted to the test adapter frame and a test adapter guide member for providing alignment of the test adapter with the receiver, wherein the test adapter guide member must be aligned with the alignment opening in the guide plate to engage the test adapter with the receiver. The engagement assembly comprises a drive shaft having first and second ends, the second end of the drive shaft having a threaded interior portion, a drive member connected to the first end of the drive shaft, and a drive screw. The drive screw comprises a threaded exterior portion, the threaded exterior portion of the drive screw engaging with the threaded interior portion of the drive shaft and an engagement member extending longitudinally away from the threaded portion of the drive screw for engaging the latch post in the receiver during engagement of the test adapter with the receiver. The alignment opening in the receiver guide member and the test adapter guide member may be, for example, rectangular, square or hexagonal in shape. Other shapes providing alignment functions also may be used. The engagement member in the test adapter may comprises a spring and a locking tab on an end of the spring.

In yet another embodiment, the present invention in an interface having a receiver and test adapter. The receiver comprises a receiver body and a latch post connected to the receiver body. The latch post comprises a latch post body, a latch post neck and a latch post tip, the latch post tip being larger than the latch post neck. The test adapter comprises a test adapter frame and an engagement assembly. The engagement assembly comprises a drive shaft having first and second ends, a drive knob connected to the first end of the drive shaft, a drive nut to the drift shaft near the second end of the drive shaft, the drive nut having a threaded interior portion, a drive screw and a drive screw housing. The drive screw comprises a threaded exterior portion, the threaded exterior portion of the drive screw engaging with the threaded interior portions of the drive nut and a spring extending longitudinally away from the threaded portion of the drive screw and having an enlarged portion at its distal end. The drive screw housing surrounds the springs, the drive screw housing having a recessed portion adjacent the enlarged portion of the spring when the engagement assembly is in a disengaged position. The latch post neck has a smaller circumference than the latch post body. A plurality of springs may extend from the drive screw for locking the test adapter to the receiver.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1A:
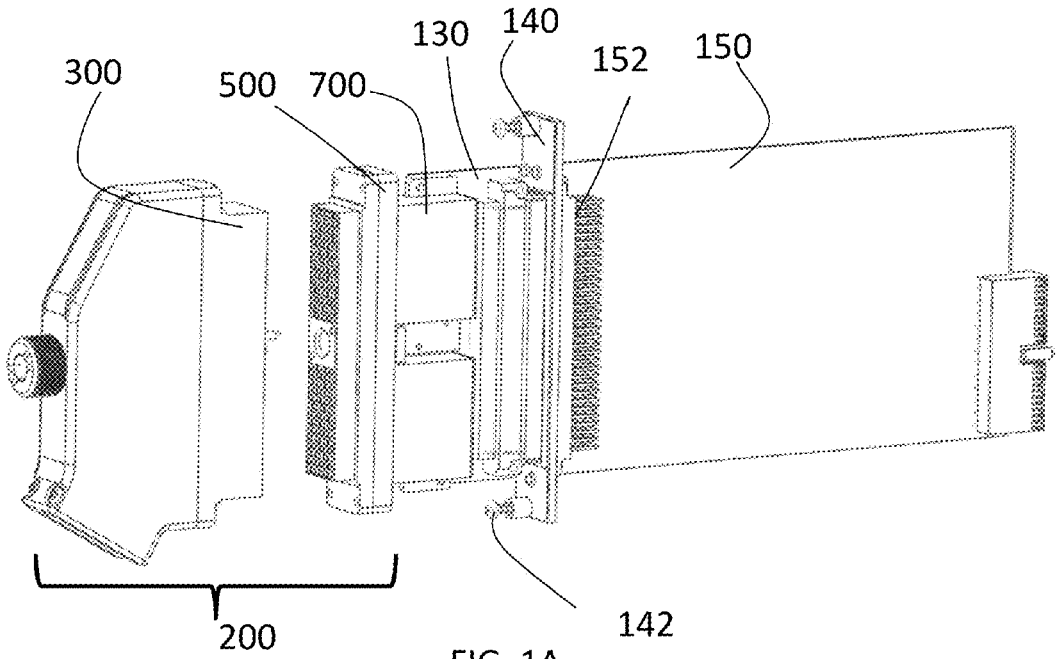
FIG. 1A is a perspective view of an interface in accordance with a first preferred embodiment of the present invention.
Figure 1B:
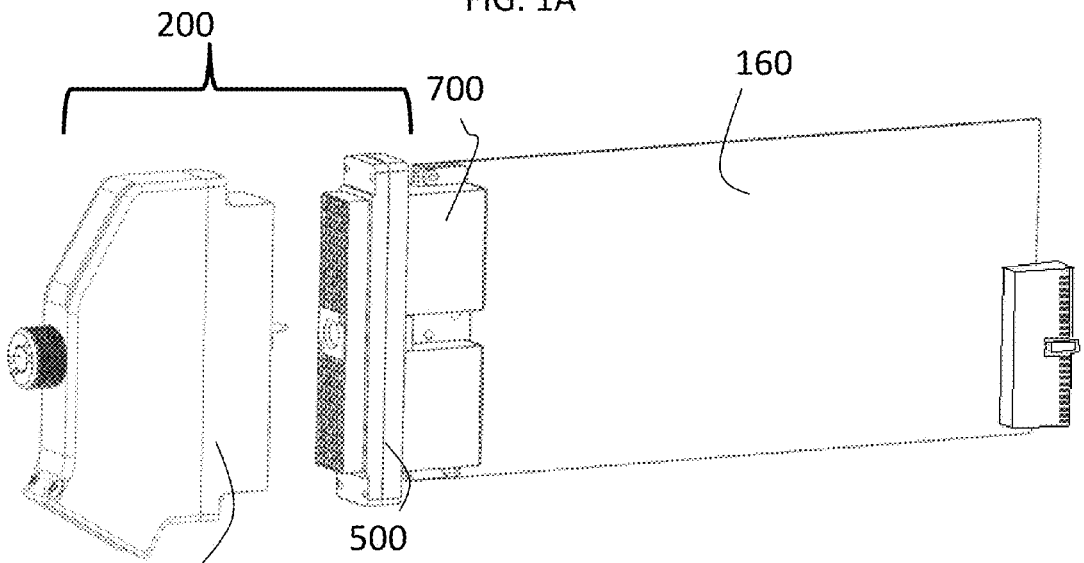
FIG. 1B is a perspective view of an interface in accordance with a second preferred embodiment of the present invention.
Figure 1C:
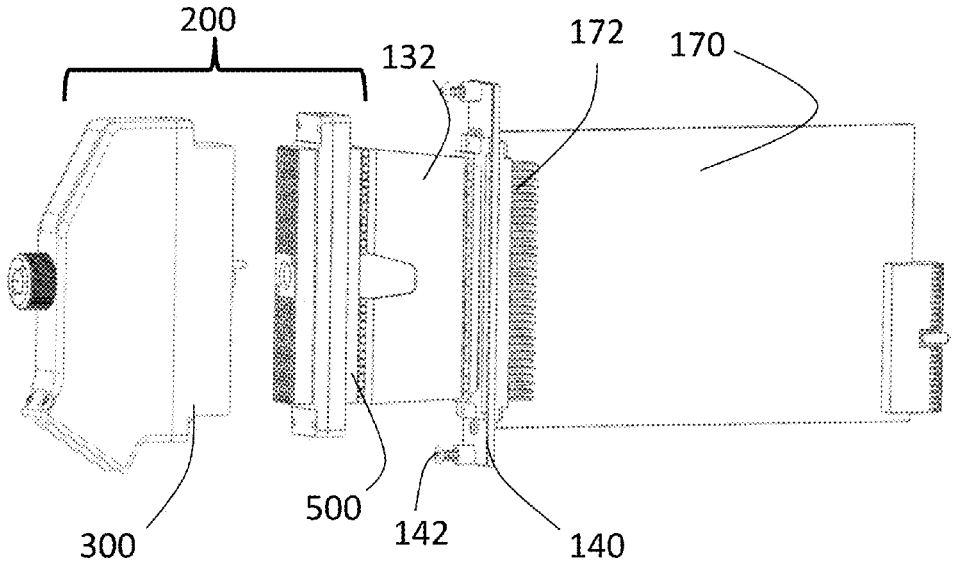
FIG. 1C is a perspective view of an interface in accordance with a third preferred embodiment of the present invention.

An interface in accordance with the present invention may be used in many different arrangements and environments. Three examples of arrangements in which preferred embodiments of the present invention are used are shown in FIG. 1A-C. The arrangements are merely exemplary, as many other arrangements and uses of the present invention will be apparent to those of skill in the art.

In FIG. 1A, an interface device 200 comprised of a test adapter 300 and a receiver 500 is connected on the receiver side to a header 700. The side of the header 700 opposite the receiver 500 is connected to a printed circuit board ("PCB") adapter card 130. The PCB adapter card 130 is connected to a header 152 of a PXI card 150 that extends through an opening in an ejector face plate 140. The ejector face plate 140 has means, such as a screw 142, near each end to connect the face plate 140 to a chassis.

FIG. 1B illustrates a second embodiment in which an interface device 200, again comprised of a receiver 500 and a test adapter 300, is connected on the receiver side to a header 700. The header 700 is connected directly to a PXI card 160.

FIG. 1C illustrates a third embodiment in which an interface device 200 is connected on the receiver side to a flex circuit 132. The flex circuit 132 is connected to a header 172 of a PXI card 170 that extends through an opening in an ejector face plate 140. The ejector face plate has means, such as a screw 142, near each end to connect the face plate 140 to a chassis.

Figure 1D:
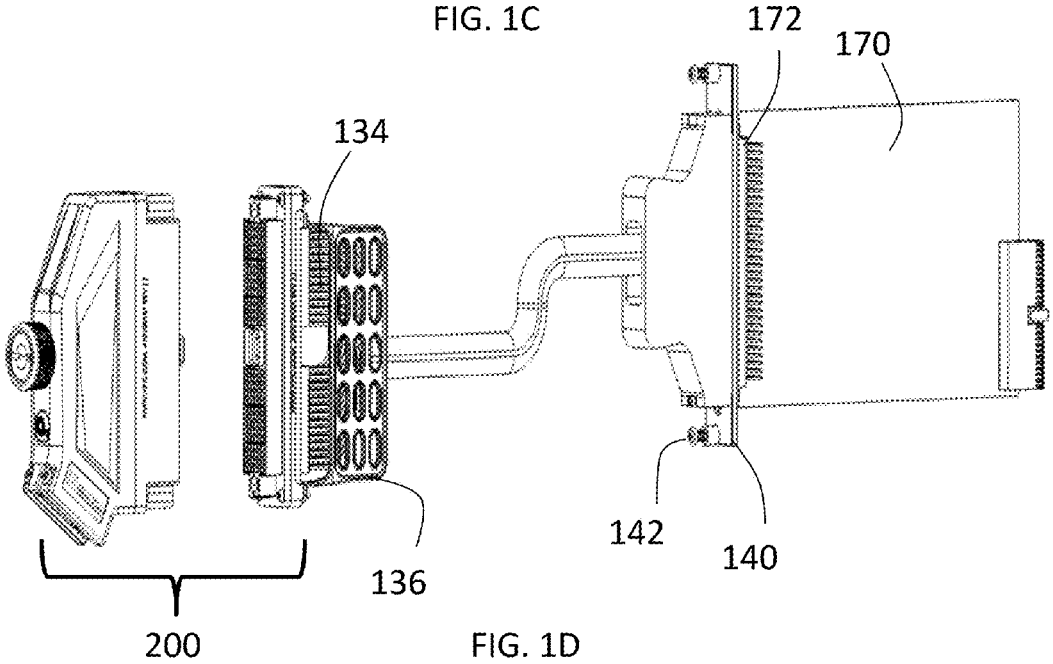
FIG. 1D is a perspective view of an interface in accordance with a fourth preferred embodiment of the present invention.
Figure 2:
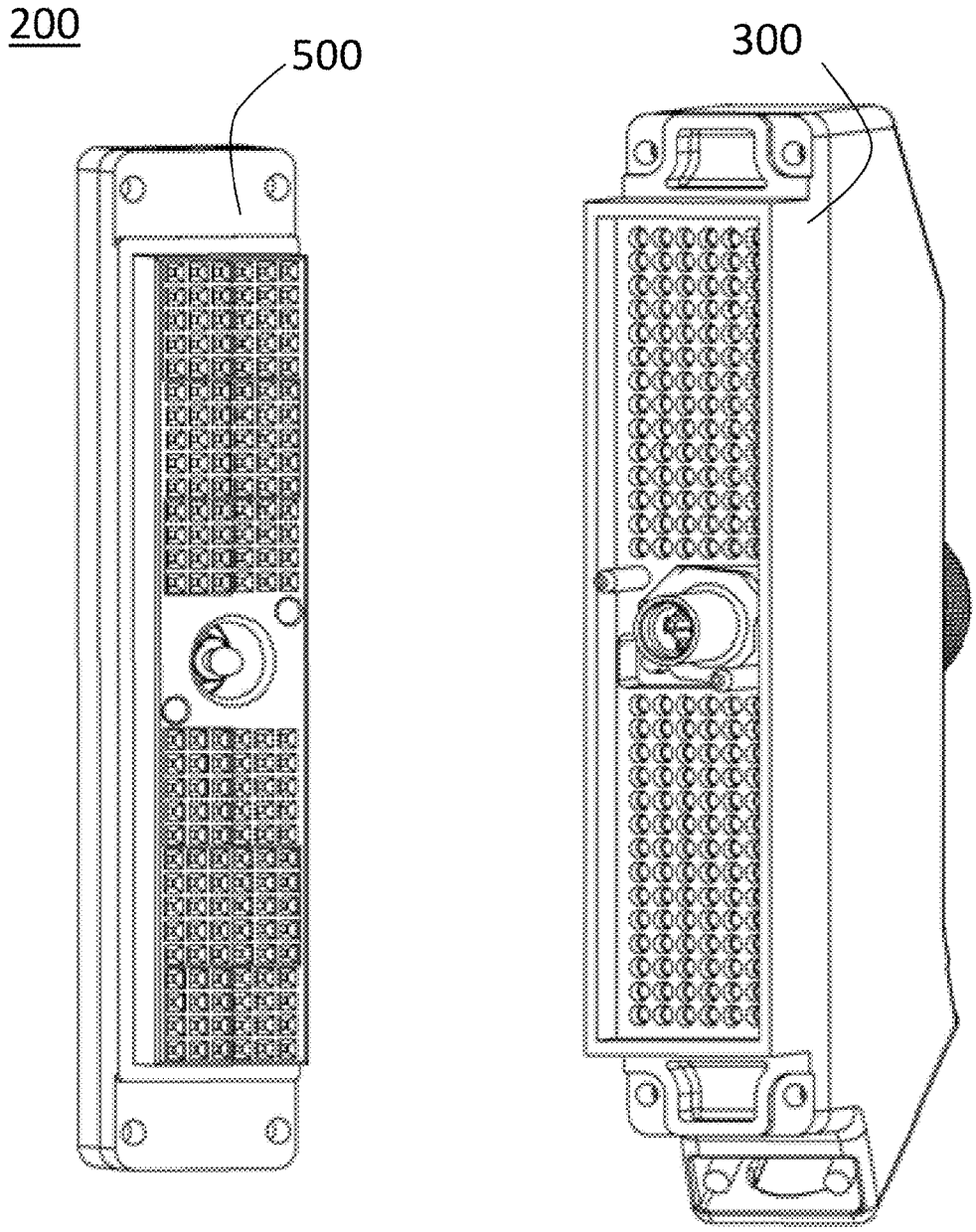
FIG. 2 is a perspective view of a receiver and test adapter of an interface device in accordance with a preferred embodiment of the present invention.
Figure 3:
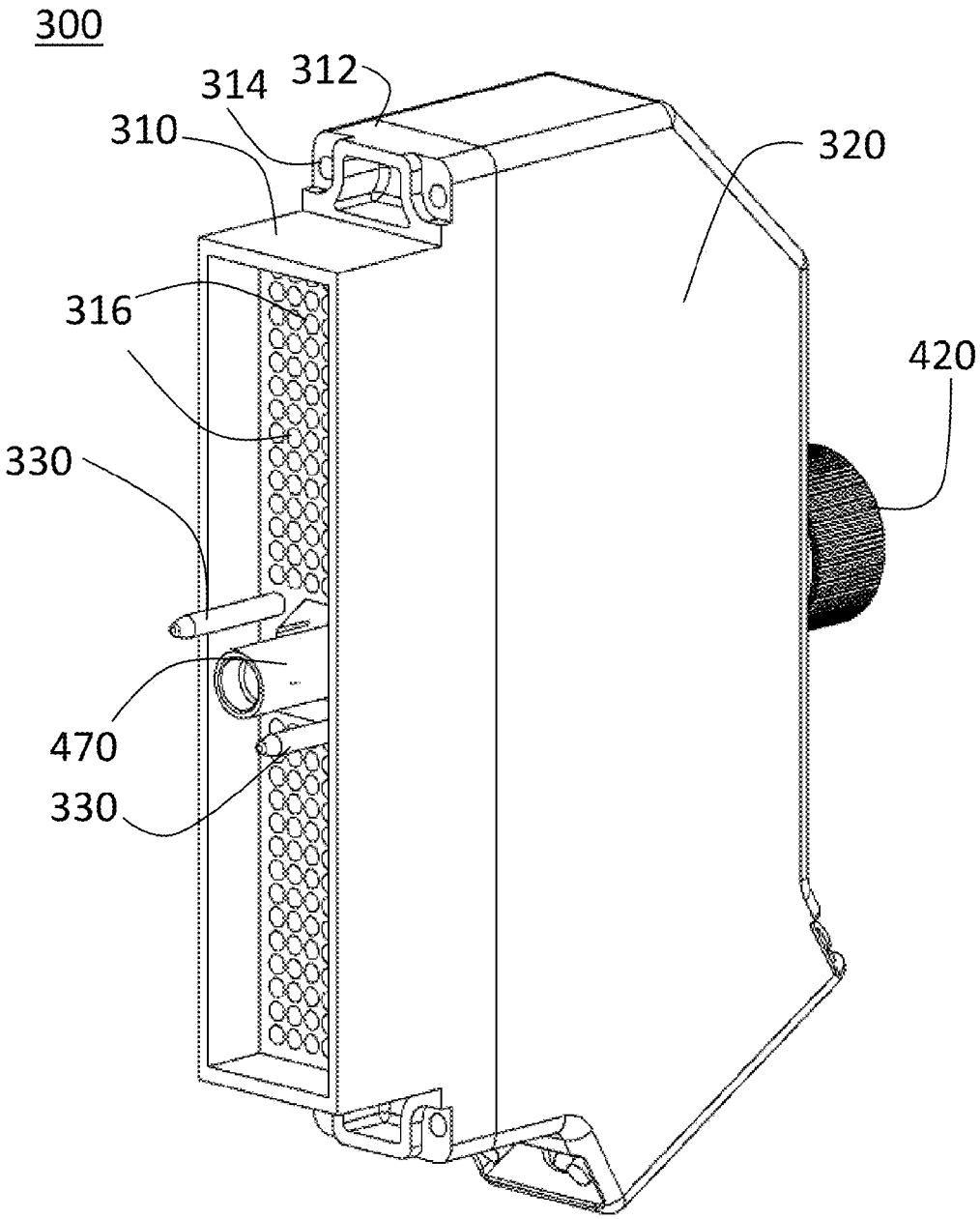
FIG. 3 is a perspective view of a test adapter of an interface device in accordance with a preferred embodiment of the present invention.
Figure 15A:
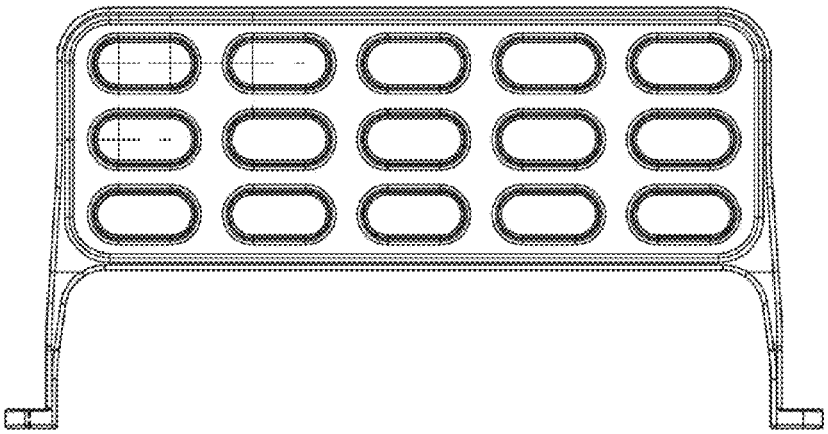
FIG. 15A is a side view of a stress relief plate of a preferred embodiment of the present invention.
Figure 15C:
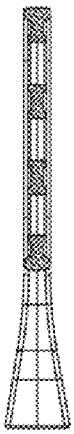
FIG. 15C is an end view of a stress relief plate of a preferred embodiment of the present invention.
Figure 15B:
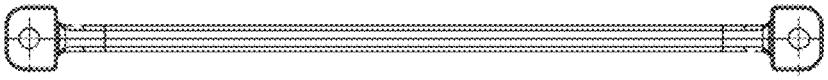
FIG. 15B is a bottom view of a stress relief plate of a preferred embodiment of the present invention.

FIG. 1D illustrates a fourth embodiment in which an interface device 200 is connected on the receiver side to discrete wiring 134 via crimp contacts. A receiver strain relief assembly 136 to provide support for the wiring 134. The wires 134 are connected to a header 172 of a PXI card 170 that extends through an opening in an ejector face plate 140. The ejector face plate has means, such as a screw 142, near each end to connect the face plate 140 to a chassis. A stress relief plate 136, shown in greater detail in FIG. 15, may be used to support the discrete wiring 134.

A first preferred embodiment of the interface device 200 comprised of test adapter 300 and receiver 500 is shown in greater detail in FIGS. 2-5. A first preferred embodiment of a test adapter 300 in accordance with the present invention is described with reference to FIGS. 3-4. The test adapter 300 has a frame 310, a cover 320 and guide pins 330. In the first preferred embodiment, the test adapter frame 310 is a solid state one-piece molded plastic component, although in other embodiments it may be formed by other means with other materials. The test adapter frame 310 has a flange 312 on each end with holes 314 through which screws are placed to attach to the cover or back shell 320 to the frame 310. The cover 320 has a cable clamp 350 for securing cables and or wires exiting the cover. The test adapter frame 310 further has a plurality of openings 316 there through for receiving contacts. In a preferred embodiment, there are two arrays (above and below the engagement mechanism 470 in FIG. 3) of 84 openings for receiving pins. Other arrangements and numbers of openings for pins of course are possible and may be used with the present invention. The guide pins 330 extend from the face of the test adapter frame 310 to align with corresponding guide holes or openings in the receiver 500. While two guide pins 330 are shown in the preferred embodiment, other arrangements such as one, three, four or another number of guide pins may be used with the present invention. Also, in FIG. 3, guide plate 470 of the engagement mechanism 400 can be seen extending from the face of the test adapter frame 310. Drive knob 420 extends from the side of the cover 320 opposite the test adapter frame 310. While a knob 420 is shown in the embodiments disclosed herein, other means such as a lever or T-shaped handle may be used as alternatives to the knob.

Figure 4A:
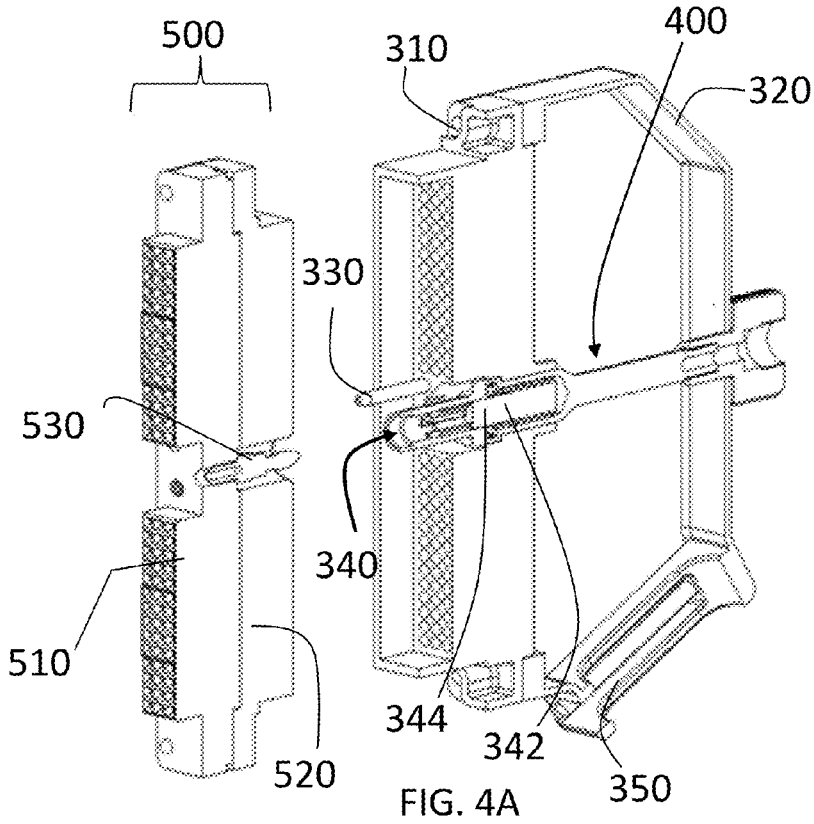
FIG. 4A is a cross-sectional perspective view of a receiver and test adapter of an interface device in accordance with a preferred embodiment of the present invention.
Figure 4B:
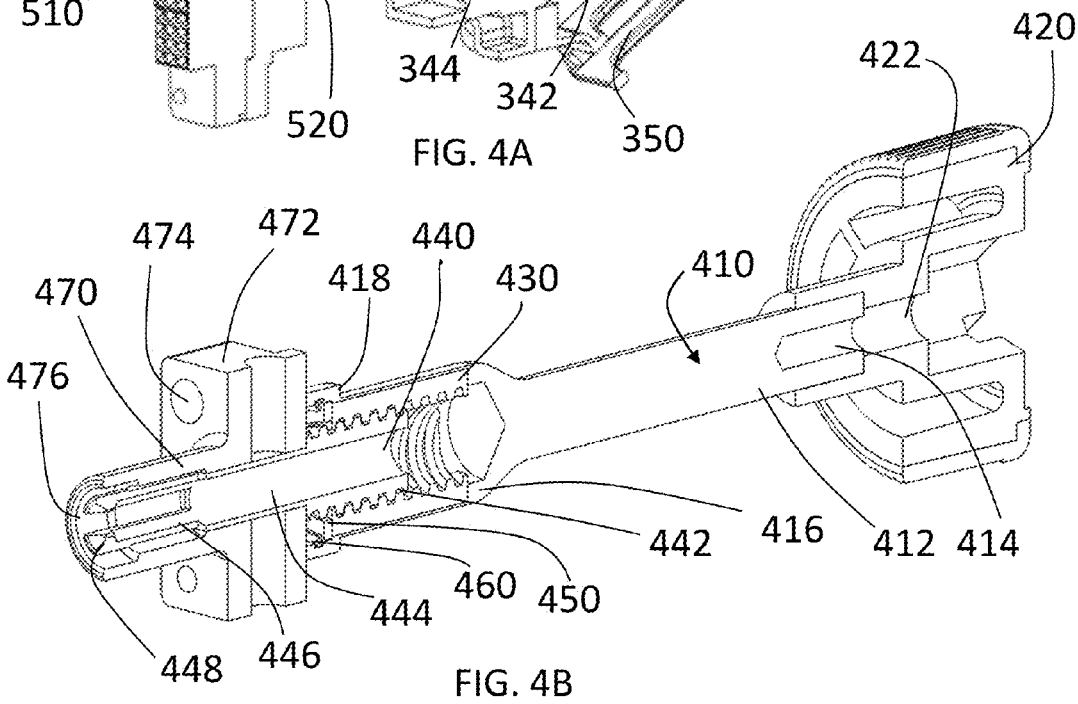
FIG. 4B is a cross-sectional perspective view of the test adapter side of an engagement mechanism of an interface device in accordance with a preferred embodiment of the present invention.
Figure 4C:
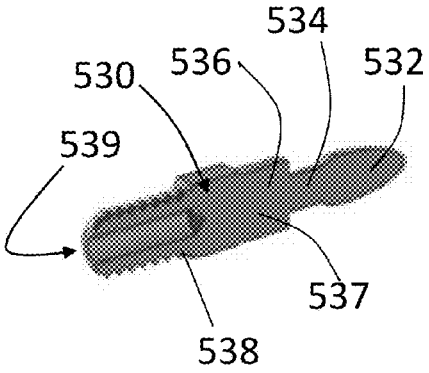
FIG. 4C is a cross-sectional perspective view of a receiver latch post of an engagement mechanism of an interface device in accordance with a preferred embodiment of the present invention.
Figure 5:
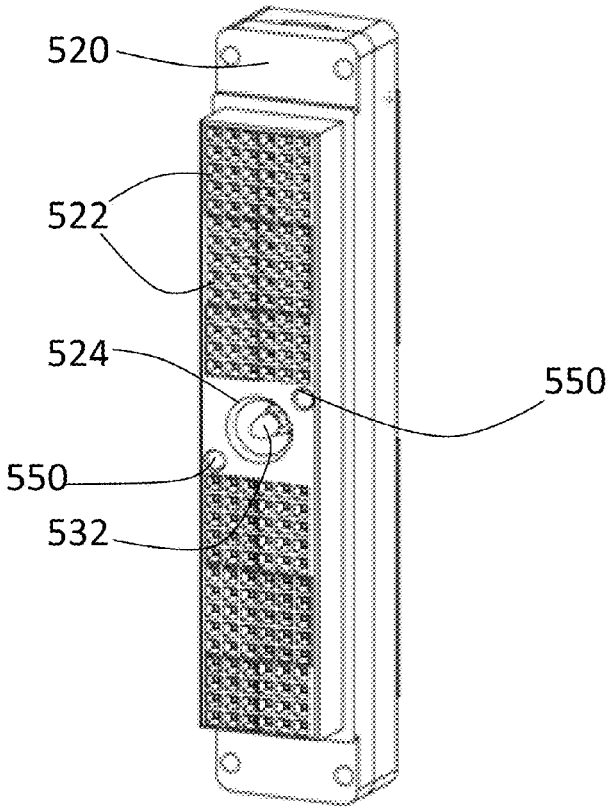
FIG. 5 is a perspective view of a receiver of an interface device in accordance with a preferred embodiment of the present invention.

FIG. 4A is a cross-sectional view of interface device 200 showing the placement of the engagement mechanism 400 in the test adapter 300 and the latch post 530 in the receiver 500. The engagement mechanism will be described with reference to FIGS. 4A and 4B. The test adapter frame 310 has an opening 340 therein through which the drive assembly 400 is inserted. The opening 340 has within it counterbore 342 and a ridge 344 for engaging with various components of the drive assembly 400 to secure the drive assembly to the test adapter frame 310. The test adapter frame 310 further has a plurality of holes (not shown) extending from the back face of the test adapter frame to the ridge 344.

The drive assembly 400 has a drive shaft 410 that is inserted through the opening 340 in the face of the test adapter frame 310 until the flange 418 on the drive shaft 410 is adjacent the counterbore 342 in the test adapter frame 310. The drive shaft 410 has an elongated portion 412 that extends out of the back of test adapter frame 310, through the cover 320, to an opening in the cover through which drive knob 420 is inserted and connected to the drive shaft 410. The end of the drive shaft 410 has a opening 414 for receiving a connecting means such as a screw for securing the drive knob 420 to the drive shaft 410 through opening 422 in the drive knob 420.

At an end opposite the end to which the drive knob 420 is attached, the drift shaft 410 has an enlarged portion 416 with a square opening therein for receiving a drive nut 430. In a preferred embodiment, the drive nut 430 is a molded plastic, but it may be made of other suitable materials, including but not limited to a machined metal. In other embodiments, the drive nut 430 could be formed integrally with the drive shaft rather than being a separate component. Similarly, while the opening in the drive shaft 410 and the drive nut 430 are square in the preferred embodiment, other suitable shapes, such as hexagonal, will be apparent to those of skill in the art. Adjacent the drive nut 430 is a thrust washer 450 and a retaining ring 460 for securing the drive nut 430 in the drive shaft 410. The drive nut 430 has a threaded hole extending through it to receive a drive screw 440. The drive screw 440 has a threaded portion 442 that engages with the threads on the interior of the drive nut 430, a square neck portion 444 extending from the threaded portion 442, and a plurality of springs 446 extending from the neck portion 444. A preferred embodiment has four springs 446, but arrangements using other numbers of springs 446 may be used. Each spring has an enlarged portion, or locking tab 448 at its distal end.

A guide plate 470 is placed over the drive screw 440 and is secured to the test adapter frame 310 until flange 472 on the guide plate 470 is adjacent the ridge 344 in the opening 340 in the test adapter frame 310. The guide plate 470 is secured to the test adapter frame 310 by inserting screws from the back side of the test adapter frame 310 through the holes (not shown) extending to ridge 344 and into threaded holes 474 in the guide plate 470. In the interior of the guide plate 470, there is a recessed portion or counterbore 476.

On the receiver side, there is a latch post 530 mounted in the receiver frame. The receiver frame is formed from front frame portion 520 and rear frame portion 510. The front frame portion 520 has an opening 524 through which the latch post 530 is inserted. The back frame portion 510 has a threaded hole or opening for receiving a threaded portion 538 of the latch post 530. The latch post has a hex-shaped body 537, which may be used when screwing the latch post 530 into the back frame portion 510 of the receiver. The latch post further has a shoulder 536, a neck portion 534 and a tip 532. The tip 532 is enlarged relative to the neck 534. The latch post further has a hole 539 in the threaded portion 538 that may receive a screw inserted through a hole 512 in the back frame portion 510 of the receiver 500. The front frame portion of the receiver further has a plurality of guide holes 550 corresponding to the guide posts 330 extending from the face of the test adapter 300.

Figure 6:
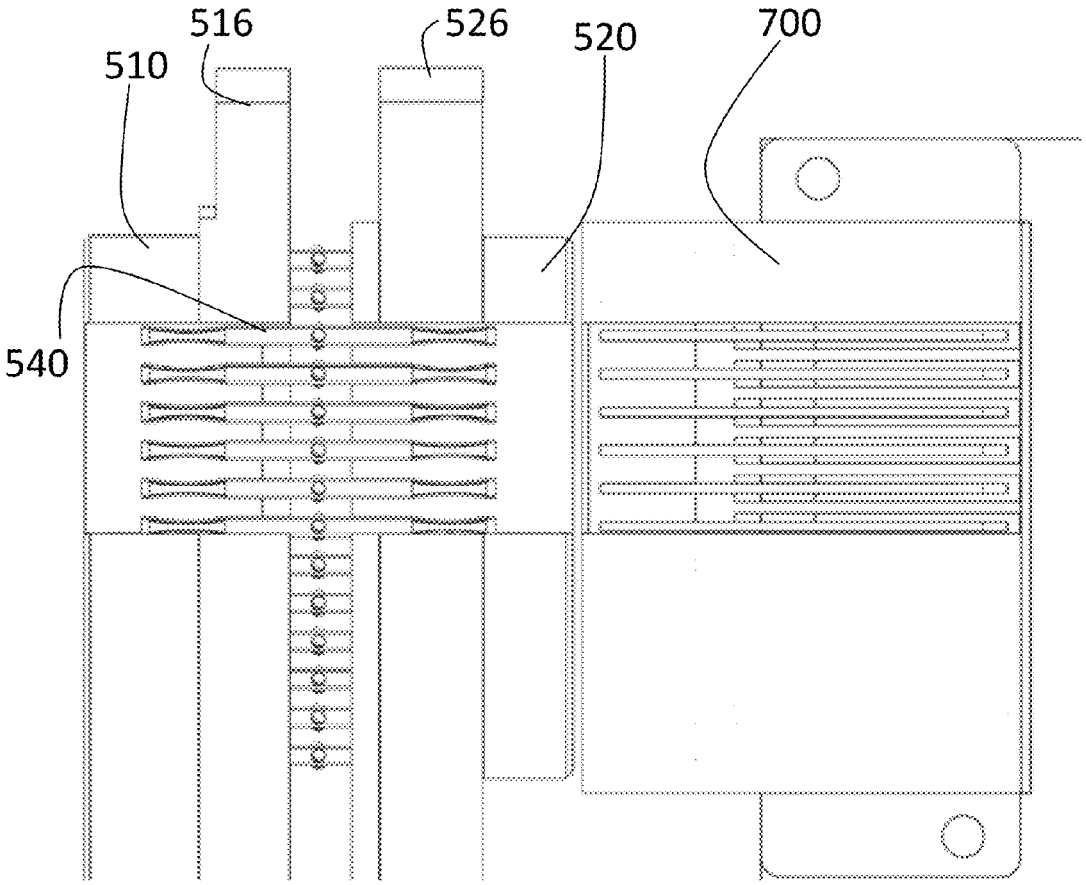
FIG. 6 is a side partial cross-sectional view of a receiver and header of an interface in accordance with a preferred embodiment of the present invention.

The front and rear frame portions of the receiver 500 each have a plurality of holes for receiving pins, as shown in FIG. 6. The sides of the front frame portion 510 and rear frame portion 520 that face one another when the receiver is assembled have holes large enough to receive pins 540. Those holes extend into the two receiver frame portions 510, 520 a distance sufficient to capture pins 540, which preferably are dual female contacts, within the receive frame when the front and back (or rear) frame portions are assembled. Other types of contacts, such as crimp contacts, may be used with the present invention. The front and rear frame portions have flanges 516, 526, which are used to connect the two receiver frame portions together. The front and rear frame portions 510, 520 further have slightly smaller openings 522 to permit pins to be inserted from each side of the receiver into the contacts 540.

To engage the test adapter 300 with the receiver 500, the test adapter 300 is aligned with the receiver 500 using the guide pins 330 in the test adapter, the guide plate 470, the guide holes 550, and the hole 524. As the latch post tip 532 is inserted into the guide plate 470, the tip 532 pushes the enlarged portions 448 of the springs 446 outward into the counterbore 476 in the guide plate 470. As the tip 532 passes the enlarged portions 448 and the latch post neck 534 is positioned adjacent the enlarged portions 448 of the springs 446, the springs flex back into their original positions. When the drive knob 420 is turned, the drive shaft 410 turns the drive nut 430. The threads on the drive nut 430 and the drive screw 440 cause the drive screw 440 to be pulled into the drive nut 430 when the drive nut is turned in the engagement direction. As the drive screw 440 is pulled into the drive nut 430, the enlarged portions 448 of the springs 446 are pulled past the counterbore 476 such that they can no longer be biased as much in an outward direction. As the drive screw 440 continues to be pulled further into the drive nut 530, the springs 446 pull the latch post tip 532 further and further into the guide plate 470 until the pins and the test adapter 300 and receiver 500 are fully mated. When disengaging the test adapter 300 from the receiver 500, the drive knob 420 is turned in an opposite or disengagement direction. This causes the drive screw 440 to move out of the drive nut 430 and push the latch post out of the guide plate 470.

Numerous other embodiments may be practiced using the present invention. In such other embodiments, various arrangements of the components, such as reversing the positioning of the drive nut and the drive screw such that the drive screw is fixed to the drive shaft and the drive nut has a plurality of springs extending therefrom, are possible. Thus, the present invention is not limited to the embodiments described above.

Figure 7A:
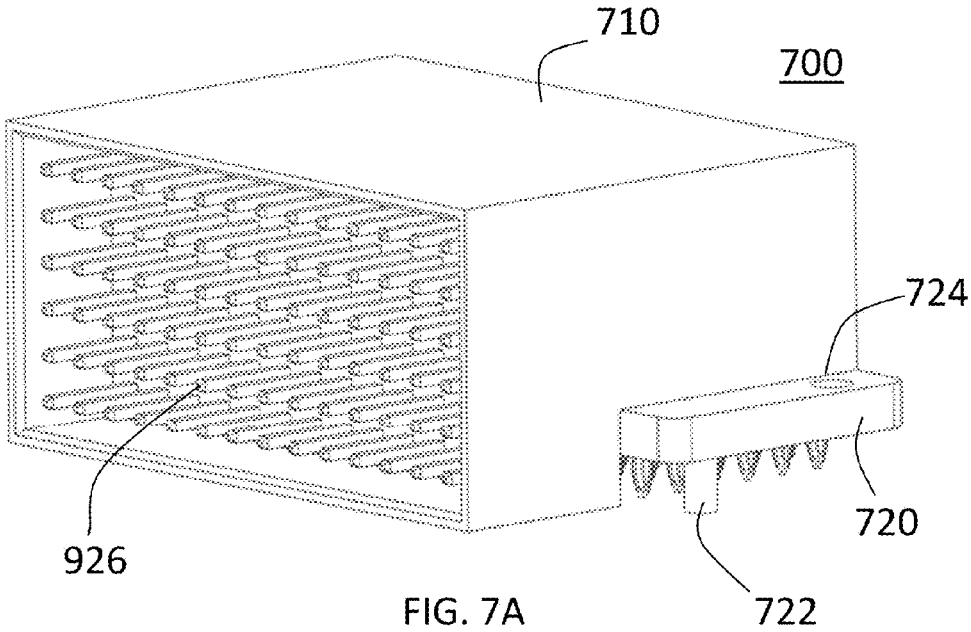
FIG. 7A is perspective view of a header of an interface in accordance with a preferred embodiment of the present invention.
Figure 7B:
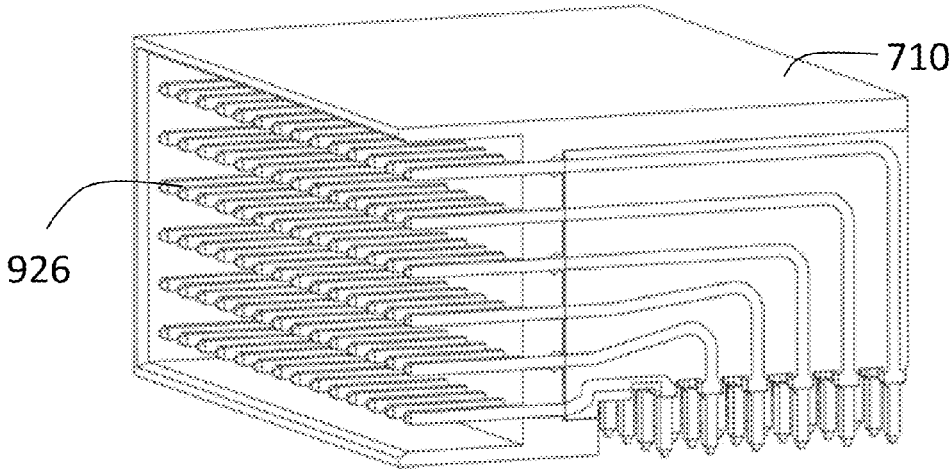
FIG. 7B is side cross-sectional view of a header of an interface in accordance with a preferred embodiment of the present invention.
Figure 8D:
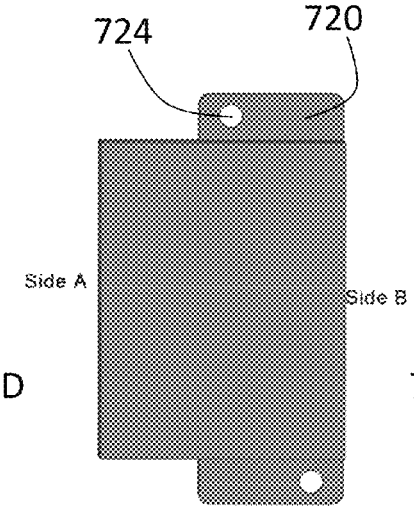
FIG. 8D is a bottom view of a header of an interface in accordance with a preferred embodiment of the present invention.
Figure 8C:
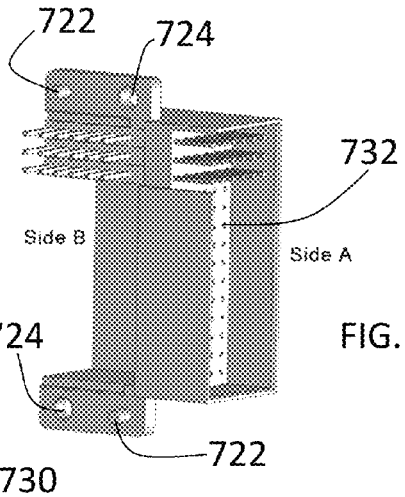
FIG. 8C is a side elevation view of a header of an interface in accordance with a preferred embodiment of the present invention.
Figure 8A:
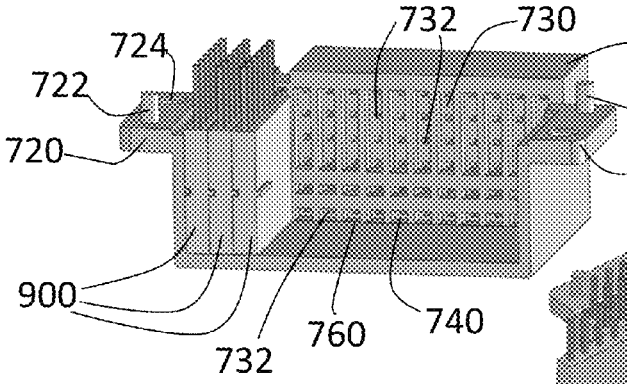
FIG. 8A is a rear elevation view of a header of an interface in accordance with a preferred embodiment of the present invention.
Figure 8B:
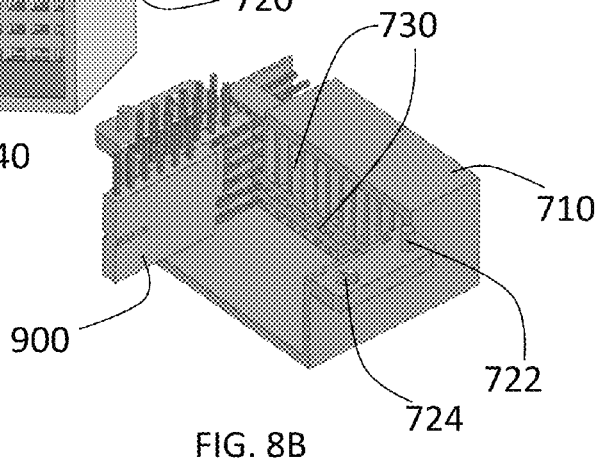
FIG. 8B is a top elevation view of a header of an interface in accordance with a preferred embodiment of the present invention.

In certain embodiments of the invention, the receiver 500 is connected to a header 700. A preferred embodiment of a header in accordance with the present invention is described with reference to FIGS. 7-9. The header 700 has a housing 710, which in a preferred embodiment is formed of molded plastic. Other materials may be used for the housing 710. The housing has a flange 720 on each side with each flange having a post 722 and a hole 724. The housing has a plurality of openings, slots or grooves 730, 740, 760 with one or more holes 732 therein for receiving contact pins 926. The holes 732 are arranged in an array having columns and rows, in this embodiment to accommodate 84 pins. Other arrangements with other numbers of pins, of course, are possible and may be used with the present invention.

Figure 9A:
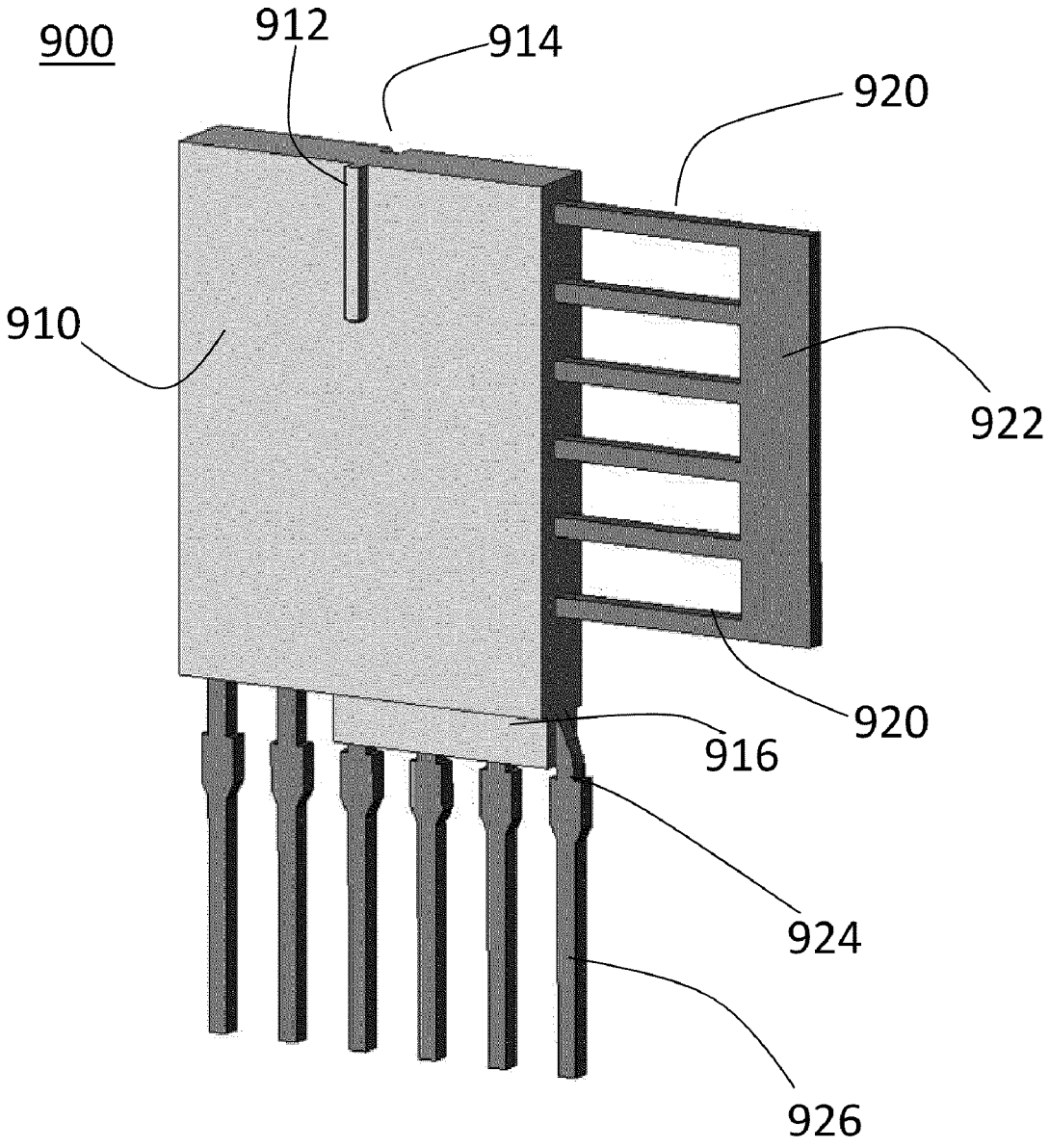
FIG. 9A is a perspective view of a header contact cartridge of an interface in accordance with a preferred embodiment of the present invention.
Figure 9B:
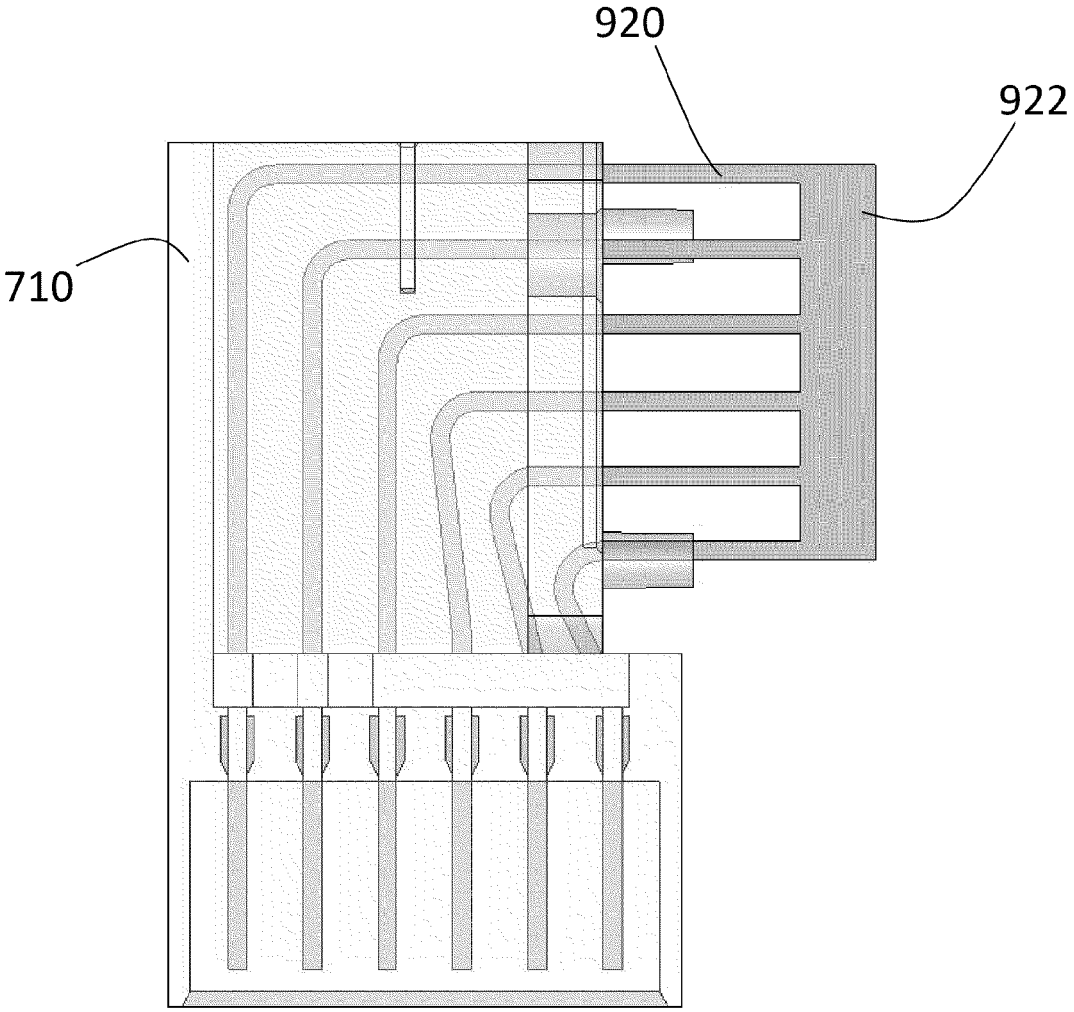
FIG. 9B is a side view of contacts of a header contact cartridge in a header of an interface in accordance with a preferred embodiment of the present invention.
Figure 9C:
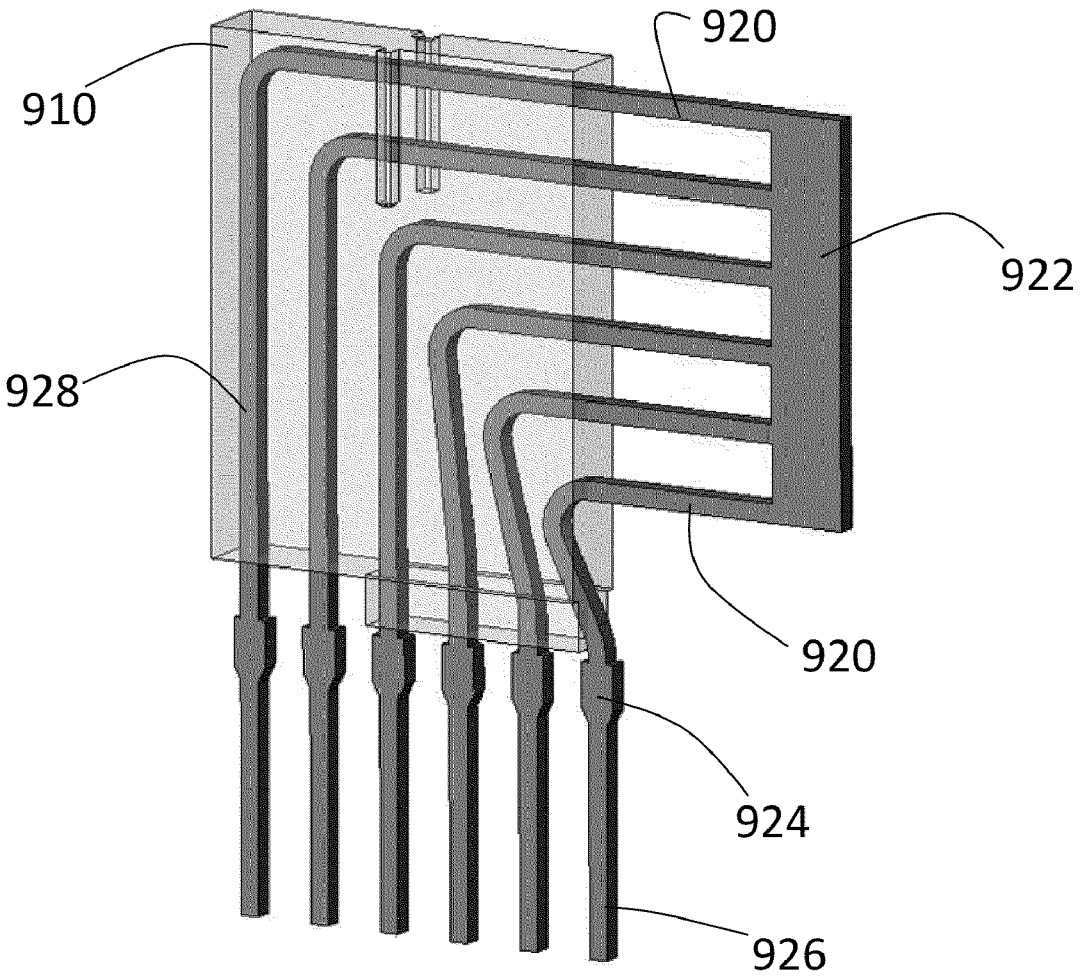
FIG. 9C is a perspective view of contacts within a header contact cartridge of an interface in accordance with a preferred embodiment of the present invention.
Figure 10A:
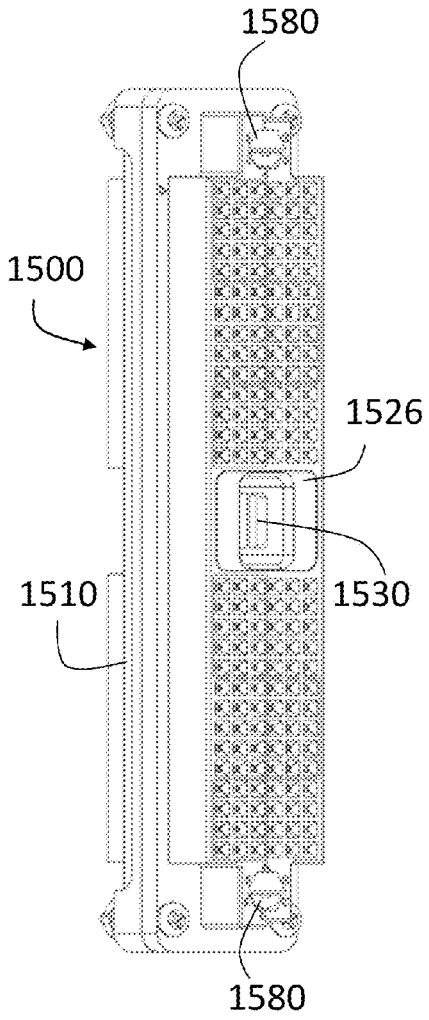
FIGS. 10A and 10B are perspective views of a receiver and test adapter of an interface device in accordance with a second preferred embodiment of the present invention.
Figure 10B:
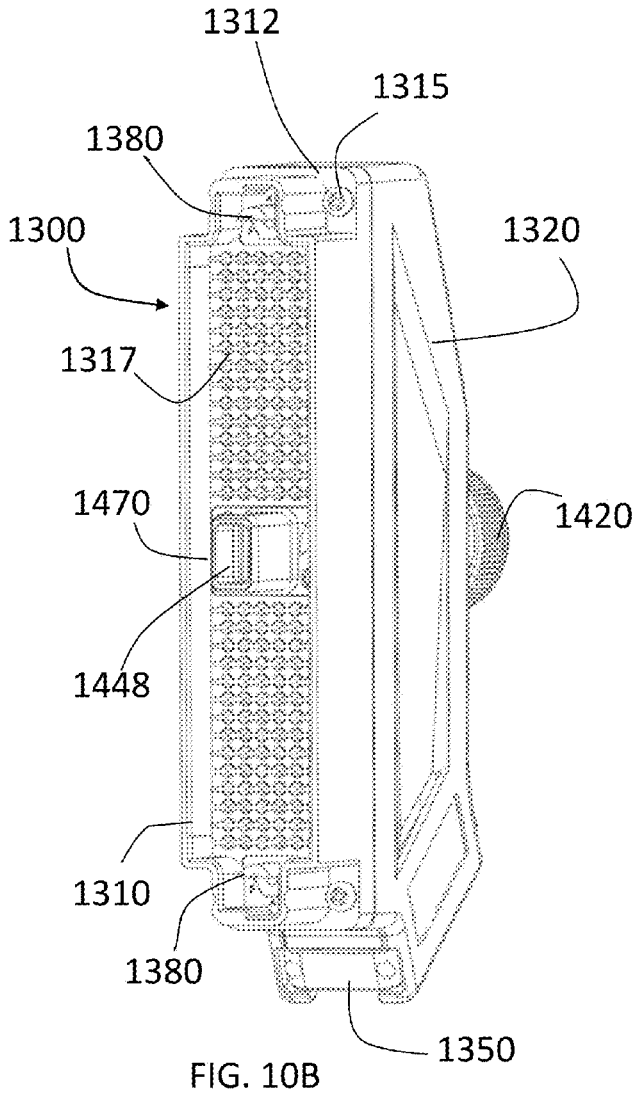

The housing is designed to hold a plurality of cartridges 900, shown in greater detail in FIGS. 9A-C, with each cartridge 900 having one row or one column of pins 920. In a preferred embodiment, each row has six pins 920, but other arrangements may be used with the present invention. A preferred embodiment of the cartridges 900 is shown in FIGS. 9A-C. A plurality of pins 920 are stamped in a stamping die in one piece. In this manner, pins for a plurality of cartridges can be rolled. A portion 922 connects the plurality of pins 920 together during the stamping and assembly processes but is removed before the cartridge 900 is used. The pins 920 are formed such that the portion of the pins connected to portion 922 is at a right angle to the portion 926 of the pins extending from an adjacent side of the cartridge 900. The ends of the portions 926 may take forms other than as shown in FIG. 9A. For example, the portions 926 alternatively may include eyelets 928 to provide for solderless contact to a printed circuit board. As shown in FIGS. 9A-C, in a preferred embodiment the pins 920 have enlarged portions 924 to assist in securing the cartridges 900 into the header housing. While FIG. 9A shows each of the six pins having an enlarged portion 924, other variations such aver other pin having an enlarged portion 924 may be used with the present invention. Shapes for enlarged portions 924 other than the shape shown in FIGS. 9A-C of course may be used with the present invention. Further, while in FIG. 9A portion 916 is shown covering only four of the six pins, other variations such as having portion 916 cover all six pins are possible. With such a variation, the openings 730, 740 and 760 shown in FIG. 8A would be combined into a single elongated slot to accommodate the alternate form of portion 916.

A particular set of pins is cut from other sets formed in a roll. The cut set of pins is placed into a mold, and a plastic shroud 910 is molded around the portion 928 of the pins 920. The plastic shroud 910 has a ridge 912 and a slot 914 formed therein to align the cartridge with other cartridges when inserted into the header housing 710 as shown in FIGS. 8A and 14A-C.

Figure 14C:
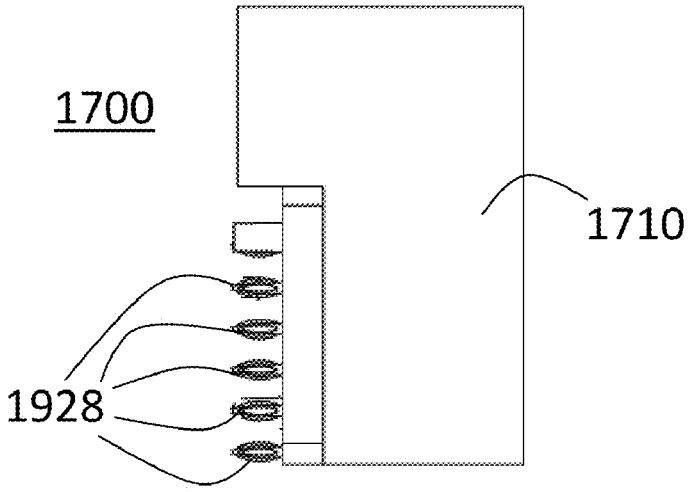
FIG. 14C is a side view of a header of an interface in accordance with a second preferred embodiment of the present invention.
Figure 14A:
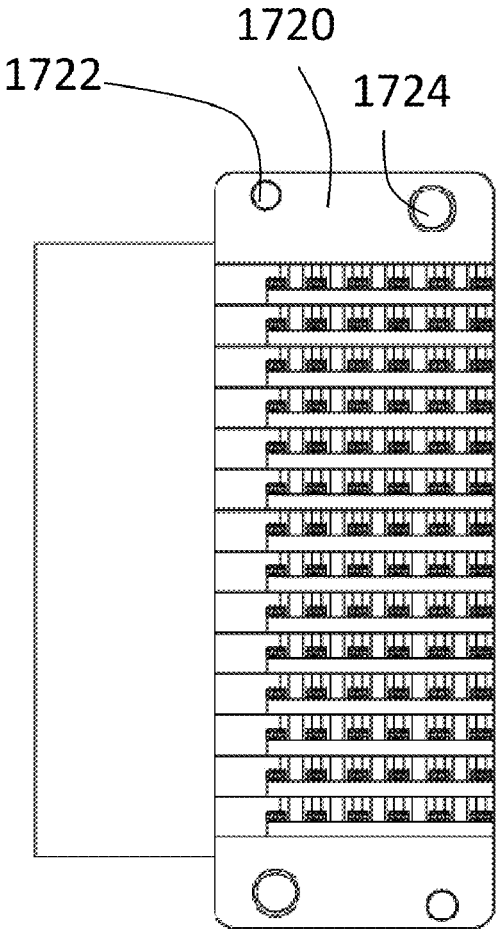
FIG. 14A is a top view of a header of an interface in accordance with a second preferred embodiment of the present invention.
Figure 14B:
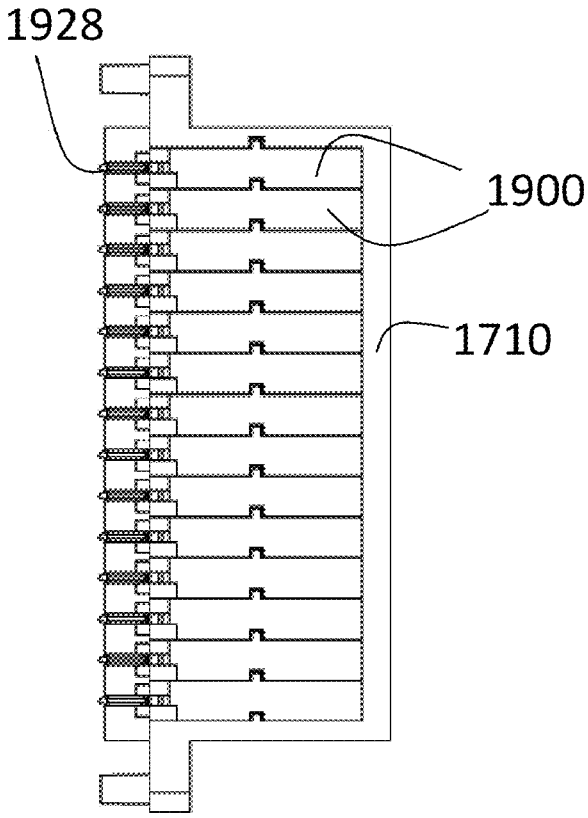
FIG. 14B is a rear view of a header of an interface in accordance with a second preferred embodiment of the present invention.

An alternative embodiment of a header is shown in FIGS. 14A-C. In this alternate embodiment, the PCB header 700A has solderless (Eye of Needle) termination tails 928 to connect to the PCB. As in the embodiments discussed previously, the contacts are within cartridges 900A which in turn are assembled in a header housing 710A.

An interface device of a second preferred embodiment in accordance with the present invention is comprised of test adapter 1300 and receiver 1500 is described with reference to FIGS. 10-13. The test adapter 1300 has a frame 1310, a removable cover or backplane 1320. In a preferred embodiment, the test adapter frame 1310 is a solid state one-piece molded plastic component, although in other embodiments it may be formed by other means with other materials. The test adapter frame 1310 has a flange 1312 on each end with holes through which screws 1315 are placed to attach to the cover or backshell 1320 to the frame 1310. The cover 1320 has a U-shaped cable clamp 1350 for securing cables and or wires exiting the cover 1320. The test adapter frame 1310 further has a plurality of openings therethrough for receiving contacts 1317. In the second preferred embodiment, there are two arrays (above and below the guide plate 1470) of 84 openings for receiving pins. Other arrangements and numbers of openings for pins of course are possible and may be used with the present invention. The test adapter 1300 has near each end a keying pin 1380 that mates with a corresponding opening 1580 on the receiver frame. A guide plate 1470 extends from the face of the test adapter frame 1310. The guide plate 1470 is rectangular in shape and thus provides vertical, horizontal and rotational alignment control when the test adapter 1300 is mated with the receiver 1500. The guide plate 1470 may have some lead-in to facilitate initial alignment with the receiver. In a preferred embodiment, the guide plate 1470 is injection molded plastic. While the guide plate 1470 is made from plastic in a preferred embodiment, other known materials may be used. Drive knob 1420 extends from the side of the cover 1320 opposite the test adapter frame 1310. The receiver 1500 has an opening therein and a bushing 1526 that aligns with the guide plate 1470 in the test adapter 1300. The bushing 1526 has a chamfer for facilitating initial alignment with the guide plate 1470. In a preferred embodiment, the bushing 1526 is made of metal, but other materials may be used in other embodiments.

Figure 11B:
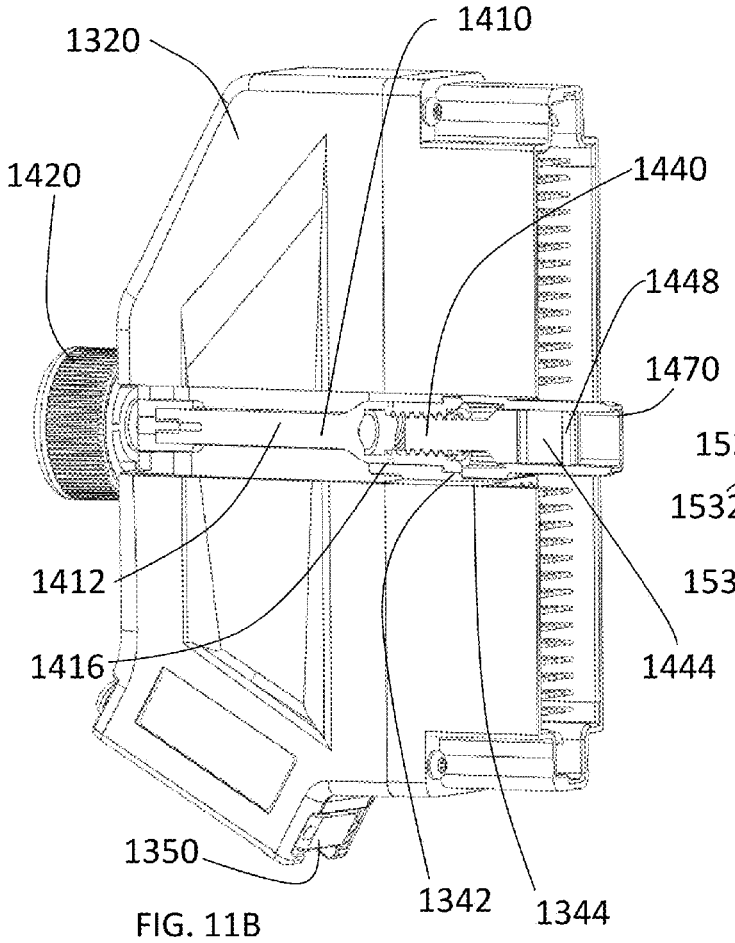
FIG. 11B is a cross-sectional perspective view of a test adapter of an interface device in accordance with a second preferred embodiment of the present invention.
Figure 11A:
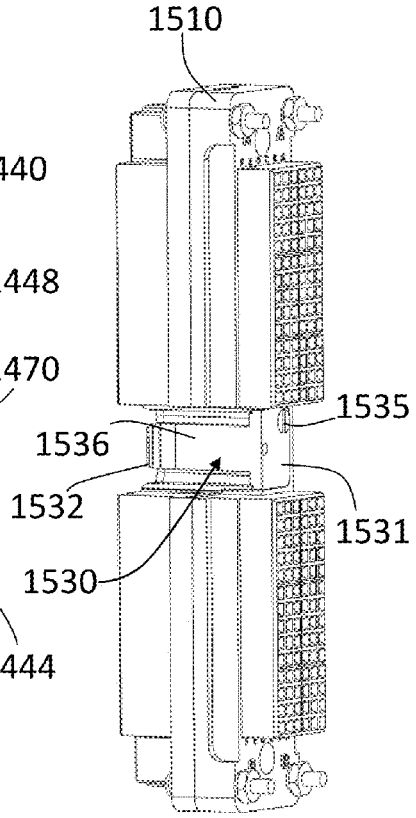
FIG. 11A is a cross-sectional perspective view of a receiver of an interface device in accordance with a second preferred embodiment of the present invention.

FIGS. 11A and 11B show a cross-sectional view of interface device showing the placement of the engagement mechanism 1400 in the test adapter 1300 and the latch post 1530 in the receiver 1500. The engagement mechanism 1400 will be described with reference to FIGS. 10A-B and 11A-B. The test adapter frame 1310 has an opening therein through which the drive assembly 1400 is inserted. The opening has within it counterbore 1344 and a ridge 1342 for engaging with various components of the drive assembly 1400 to secure the drive assembly to the test adapter frame 1310.

The drive assembly 1400 has a drive shaft 1410 that is inserted through the opening in the face of the test adapter frame 1310 until the flange on the drive shaft 1410 is adjacent the counterbore 1344 in the test adapter frame 1310. The drive shaft 1410 has an elongated portion 1412 that extends out of the back of test adapter frame 1310, into cover 1320, near an opening in the cover through which drive knob 1420 is inserted and connected to the drive shaft 1410. The end of the drive shaft 1410 is connected to the drive knob 1420 which has a portion extending through an opening in the cover 1320.

At an end opposite the end to which the drive knob 1420 is attached, the drive shaft 1410 has an enlarged portion 1416 which has a threaded opening therein for receiving a drive screw 1440. The drive screw 1440 has a threaded portion 1441 that engages with the threads on the interior of the threaded opening of the drive shaft 1410, a neck portion 1444 extending from the threaded portion, and a locking portion or member 1448 extending from the neck portion 1444.

The guide plate 1470 is placed over the drive screw 1440 and is secured to the test adapter frame 1310 until a flange on the guide plate 1470 is adjacent a ridge in the opening in the test adapter frame 1310. On the receiver side, there is a latch post 1530 mounted in the receiver frame.

Figure 12A:
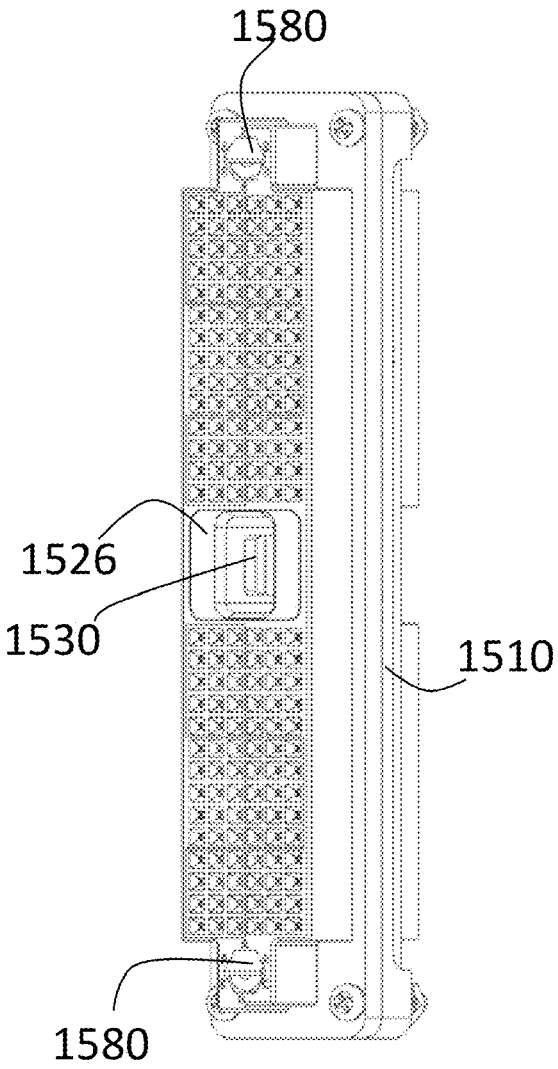
FIG. 12A is a perspective view of a receiver in accordance with a second preferred embodiment of the present invention.
Figure 12B:
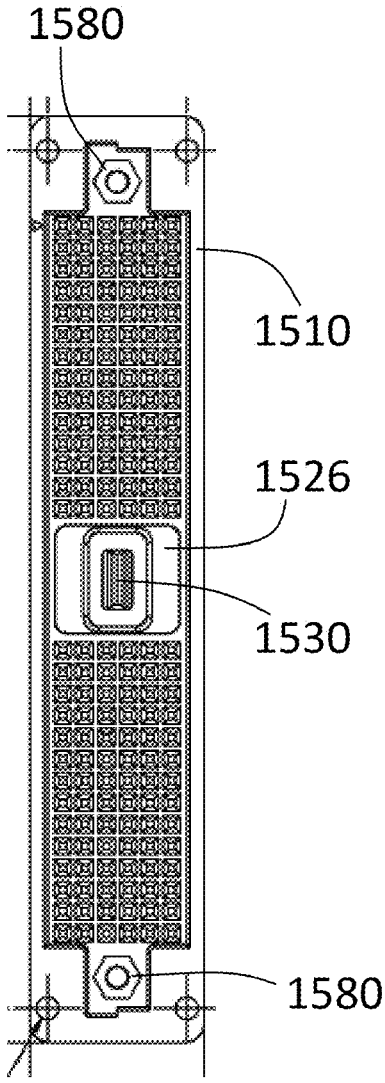
FIG. 12B is a front view of a receiver in accordance with a second preferred embodiment of the present invention.
Figure 12C:
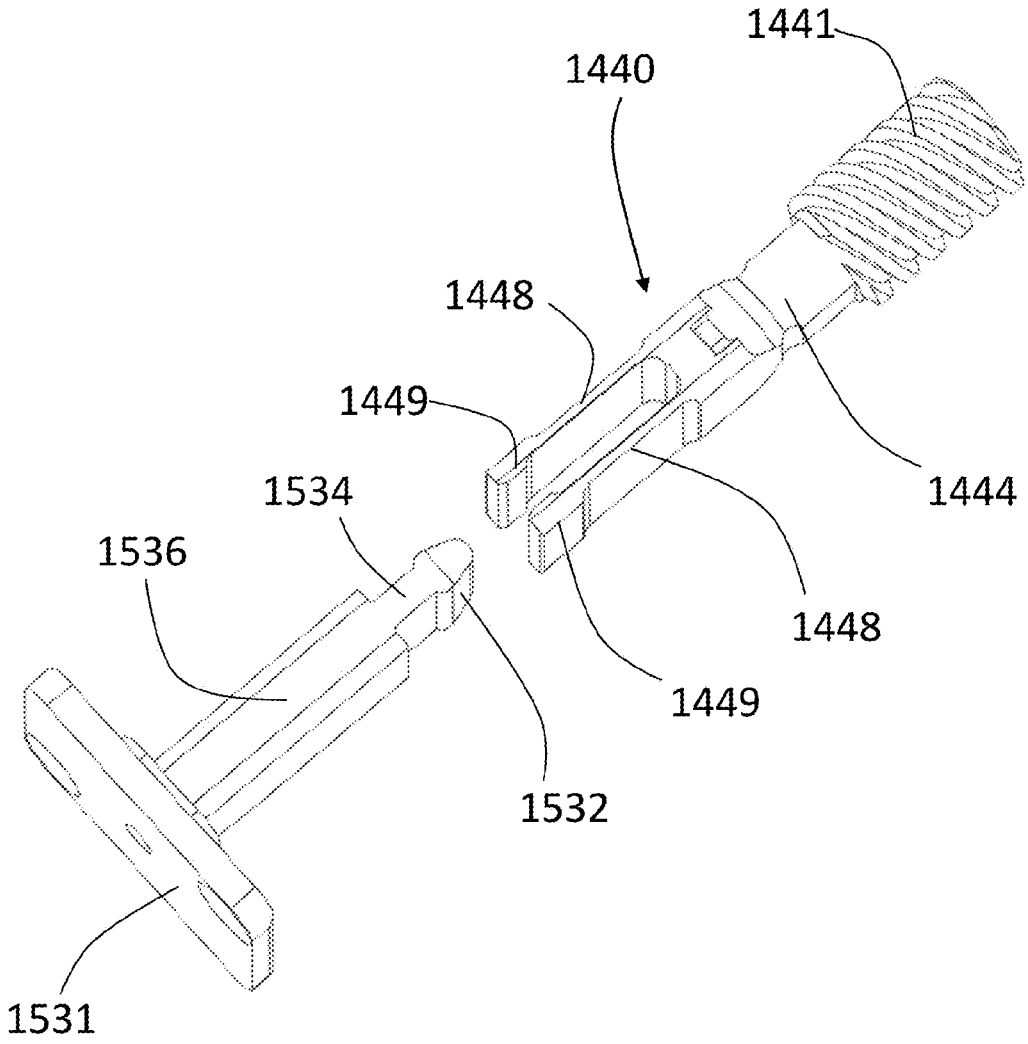
FIG. 12C is a perspective view of a receiver latch post and a test adapter drive screw in accordance with a second preferred embodiment of the present invention.
Figure 13A:
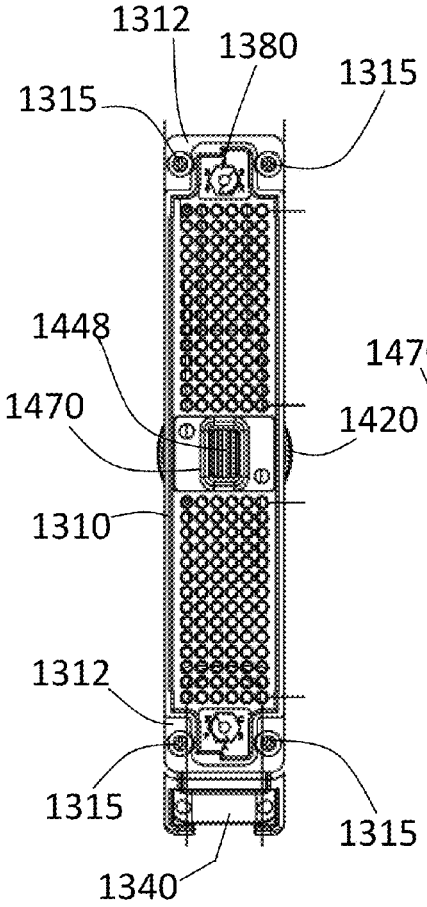
FIG. 13A is a front view of a test adapter in accordance with a second preferred embodiment of the present invention.
Figure 13B:
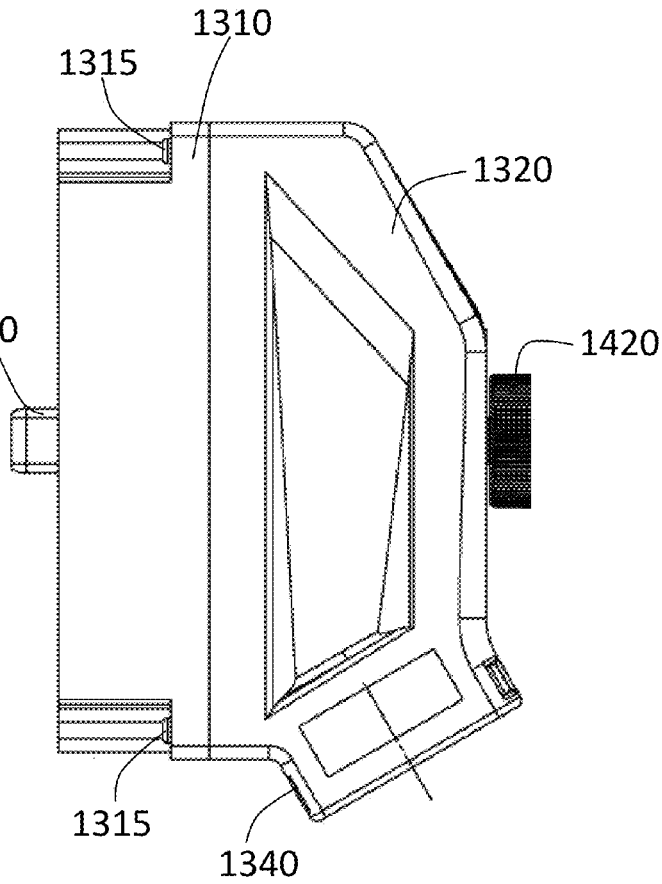
FIG. 13B is a side view of a test adapter in accordance with a second preferred embodiment of the present invention.

The receiver frame portion has an opening through which the latch post 1530 is inserted. As shown in FIG. 12C, the latch post 1530 has a mounting portion 1531, an elongated portion 1536, a neck 1534 and an engagement portion 1532. The mounting portion 1531 is used to mount the latch post 1530 to the receiver frame 1510, for example, via screws 1535 placed through holes in the mounting member and into corresponding threaded holes in the receiver frame 1510. The engagement portion 1532 or member has means for engaging with the locking portion 1448 of the drive screw 1440 when engaging the ITA with the receiver. The means for engaging with the locking portion, for example, may be an enlarged portion, a spring member or members, or any other known locking means. In FIGS. 10-11, the guide plate or member 1470 on the ITA and the opening in the bushing 1526 are shown as rectangular in shape. This shape provides for horizontal, vertical and rotational alignment of the test adapter 1300 with the receiver 1500 when mating. This removes the need for guide pins 330 and holes 550 arrangement included in the embodiment shown in FIGS. 3-5. Other shapes, such as square, hexagonal and many other shapes alternatively may be used.

An alternative embodiment of a header 1700 is shown in FIGS. 14A-C and 16A-D. In this alternate embodiment, the PCB header 1700 has solderless (Eye of Needle) termination tails 1928 to connect to the PCB. As in the embodiments discussed previously, the contacts are within cartridges 1900 which in turn are assembled in a header housing 1710.

The header 1700 has a housing 1710, which in a preferred embodiment is formed of molded plastic. Other materials may be used for the housing 1710. The housing has a flange 1720 on each side with each flange having a post 1722 and a hole 1724. The housing has a plurality of openings, slots or grooves 1730 with one or more holes 1732 therein for receiving contact pins 1926. The holes 1732 are arranged in an array having columns and rows, in this embodiment to accommodate 84 pins. Other arrangements with other numbers of pins, of course, are possible and may be used with the present invention.

Figure 16D:
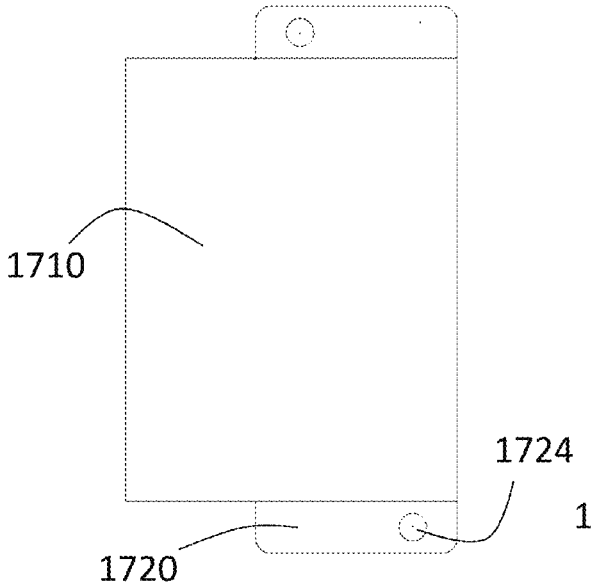
FIG. 16D is a bottom view of a header of an interface in accordance with a second preferred embodiment of the present invention.
Figure 16C:
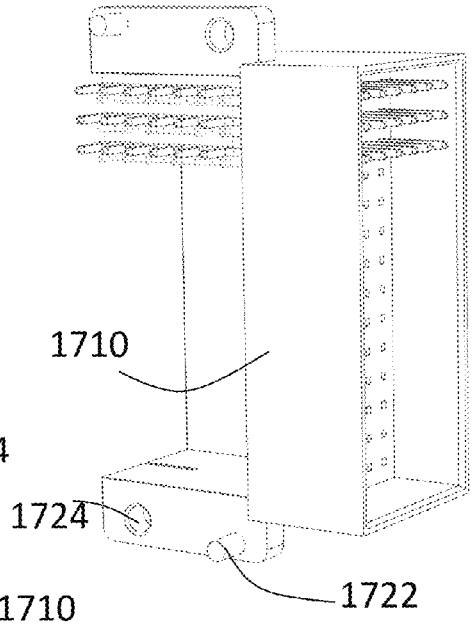
FIG. 16C is a side elevation view of a header of an interface in accordance with a second preferred embodiment of the present invention.
Figure 16A:
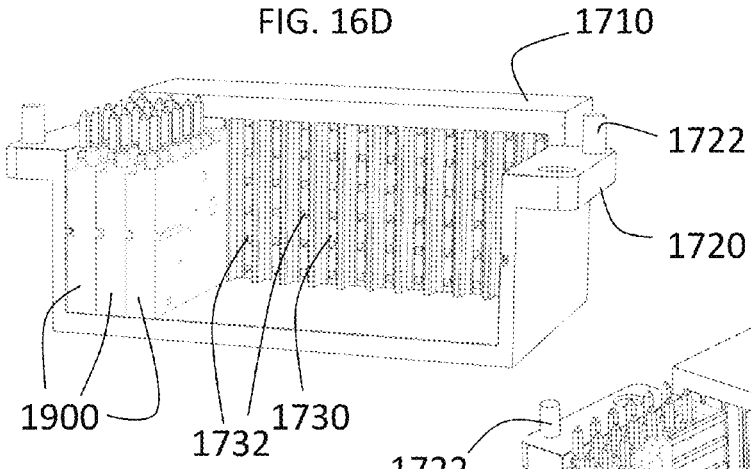
FIG. 16A is a rear elevation view of a header of an interface in accordance with a second preferred embodiment of the present invention.
Figure 16B:
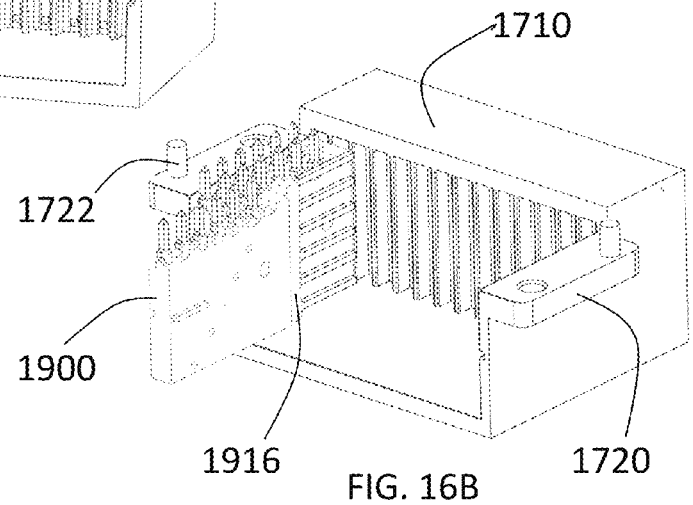
FIG. 16B is a top elevation view of a header of an interface in accordance with a second preferred embodiment of the present invention.

The housing is designed to hold a plurality of cartridges 1900 with each cartridge 1900 having one row or one column of pins 1920. In a preferred embodiment, each row has six pins 1920, but other arrangements may be used with the present invention. The ends of the pins take the form of eyelets 1928 such as shown in FIGS. 14A-C to provide for solderless contact to a printed circuit board. Further, while in FIG. 9A portion 916 covered only four of the six pins, the portion 1916 in the second embodiment shown in FIG. 16B covers all six pins. With such a variation, the openings 1730 shown in FIG. 16A is a single elongated slot to accommodate the portion 1916.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An interface comprising:
- a receiver comprising:
  - a receiver body;
  - a latch post connected to said receiver body, said latch post comprising:
    - a latch post body; and
    - a latch post tip; and
  - a receiver guide member;
- a test adapter comprising:
  - a test adapter frame;
  - an engagement assembly mounted to said test adapter frame, said engagement assembly comprising:
    - a drive shaft having first and second ends, said second end of said drive shaft having a threaded interior portion;
    - a drive knob connected to said first end of said drive shaft;
    - a drive screw comprising:
      - a threaded exterior portion, said threaded exterior portion of said drive screw engaging with said threaded interior portion of said drive shaft; and
      - an engagement member extending longitudinally away from said threaded portion of said drive screw for engaging said latch post in said receiver during engagement of said test adapter with said receiver; and
  - a test adapter guide member for providing alignment of said test adapter with said receiver.

2. An interface according to claim 1, wherein said drive shaft comprises an opening at said second end and a drive nut within said opening in said second end, said drive nut having a threaded interior portion.

3. An interface according to claim 1, further comprising a drive screw housing surrounding said springs, said drive screw housing having a recessed portion adjacent said enlarged portion of said spring when said engagement assembly is in a disengaged position.

4. An interface according to claim 1, wherein said latch post further comprises a latch post neck between said latch post body and said latch post tip and wherein said latch post neck has a smaller circumference than said latch post tip.

5. An interface according to claim 1, wherein said engagement member comprises a plurality of springs extending from said drive screw, wherein said plurality of springs engage with said latch post tip when said test adapter is mated with said receiver.

6. An interface according to claim 1, wherein said test adapter guide member comprises a rectangular-shaped guide mounted to said test adapter frame and protruding from a face of said test adapter and said receiver guide member comprises a bushing mounted to said receiver frame and having an opening matching said rectangular shape of said test adapter guide member to permit said test adapter guide member to be inserted into said opening in said bushing and thereby align said test adapter with said receiver.

7. An interface according to claim 1, wherein said test adapter guide member comprises a guide post mounted to said test adapter frame and protruding from a face of said test adapter and said receiver guide member comprises a hole in said receiver frame having an opening matching said guide post to permit said guide post to be inserted into said opening in said receiver frame and thereby align said test adapter with said receiver.

8. An interface according to claim 1, further comprising a header connected to said receiver, wherein said header comprises:

a header housing; and a plurality of cartridges removably mounted in said header housing, each said cartridge comprising:

a plurality of pins and a casing surrounding a portion of each of said plurality of pins.

9. An interface according to claim 8, wherein a plurality of said pins have a retention structure for removably securing said cartridge into said header housing.

10. An interface according to claim 1 wherein said engagement member in said test adapter comprises a plurality of springs and a locking tab on one end of each said spring.

11. An interface comprising:

a receiver comprising:

a receiver body; and a latch post connected to said receiver body, said latch post comprising:

a latch post body; and a latch post tip; and a guide plate mounted to said receiver body, wherein said guide plate has an alignment opening therein that surrounds said latch post;

a test adapter comprising:

a test adapter frame; and an engagement assembly mounted to said test adapter frame, said engagement assembly comprising:

a drive shaft having first and second ends, said second end of said drive shaft having a threaded interior portion;

a drive member connected to said first end of said drive shaft;

a drive screw comprising:

a threaded exterior portion, said threaded exterior portion of said drive screw engaging with said threaded interior portion of said drive shaft; and an engagement member extending longitudinally away from said threaded portion of said drive screw for engaging said latch post in said receiver during engagement of said test adapter with said receiver; and a test adapter guide member for providing alignment of said test adapter with said receiver, wherein said test adapter guide member must be aligned with said alignment opening in said guide plate to engage said test adapter with said receiver.

12. An interface according to claim 11, wherein said alignment opening in said receiver guide member and said test adapter guide member are rectangular in shape.

13. A interface according to claim 11 wherein said engagement member in said test adapter comprises a spring and a locking tab on an end of said spring.

14. An interface comprising:

a receiver comprising:

a receiver body; and a latch post connected to said receiver body, said latch post comprising:

a latch post body;

a latch post neck; and a latch post tip, said latch post tip being larger than said latch post neck;

a test adapter comprising:

a test adapter frame; and an engagement assembly, said engagement assembly comprising:

a drive shaft having first and second ends;

a drive knob connected to said first end of said drive shaft;

a drive nut to said drift shaft near said second end of said drive shaft, said drive nut having a threaded interior portion;

a drive screw comprising:

a threaded exterior portion, said threaded exterior portion of said drive screw engaging with said threaded interior portions of said drive nut; and a spring extending longitudinally away from said threaded portion of said drive screw and having an enlarged portion at its distal end; and a drive screw housing surrounding said springs, said drive screw housing having a recessed portion adjacent said enlarged portion of said spring when said engagement assembly is in a disengaged position.

15. An interface according to claim 14, wherein said latch post neck has a smaller circumference than said latch post body.

16. An interface according to claim 14, wherein a plurality of springs extend from said drive screw.

* * * * *